US010996589B2

(12) United States Patent
Sasaki et al.

(10) Patent No.: US 10,996,589 B2
(45) Date of Patent: May 4, 2021

(54) METHOD FOR DISASSEMBLING DEVELOPING DEVICE AND METHOD FOR RECYCLING DEVELOPING DEVICE

(71) Applicant: CANON KABUSHIKI KAISHA, Tokyo (JP)

(72) Inventors: Teruhiko Sasaki, Mishima (JP); Osamu Anan, Susono (JP); Yuuki Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/791,890

(22) Filed: Feb. 14, 2020

(65) Prior Publication Data

US 2020/0272074 A1 Aug. 27, 2020

(30) Foreign Application Priority Data

Feb. 26, 2019 (JP) ..... JP2019-033354

(51) Int. Cl.
*G03G 15/08* (2006.01)

(52) U.S. Cl.
CPC ..... *G03G 15/0894* (2013.01)

(58) Field of Classification Search
CPC ..... G03G 15/0894; G03G 15/0812; G03G 21/181; G03G 21/1821; G03G 15/0898; G03G 21/1832
See application file for complete search history.

(56) References Cited

U.S. PATENT DOCUMENTS

| | | | | |
|---|---|---|---|---|
| 9,069,331 | B2 * | 6/2015 | Fujii | G03G 21/1832 |
| 9,104,139 | B2 * | 8/2015 | Hoshi | G03G 21/181 |
| 2005/0141916 | A1 * | 6/2005 | Arimitsu | G03G 21/1832 399/111 |
| 2020/0103787 | A1 * | 4/2020 | Wang | G03G 15/0812 |

FOREIGN PATENT DOCUMENTS

| | | | |
|---|---|---|---|
| JP | 2009288286 | A | 12/2009 |
| JP | 2017156474 | A | 9/2017 |

* cited by examiner

*Primary Examiner* — Arlene Heredia
*Assistant Examiner* — Arlene J Heredia Ocasio
(74) *Attorney, Agent, or Firm* — Canon U.S.A., Inc. IP Division

(57) ABSTRACT

A method for disassembling a developing device. The developing device includes a frame configured to store a developer, a developer bearing member, a regulation member configured to regulate the developer borne by the developer bearing member, and a fixing member configured to fix the regulation member to the frame. The fixing member has a holding portion configured to hold the regulation member. The developing device includes a cover portion attached to the regulation member and configured to cover at least a part of the holding portion. The disassembling method includes cover removing for removing at least a part of the cover portion to reduce the size of a region of the holding portion covered by the cover portion.

18 Claims, 19 Drawing Sheets

METHOD FOR DISASSEMBLING DEVELOPING DEVICE AND METHOD FOR RECYCLING DEVELOPING DEVICE

BACKGROUND OF THE DISCLOSURE

Field of the Disclosure

The present disclosure relates to a method for disassembling a developing device used for copiers, printers, and other electrophotographic image forming apparatuses, and to a method for recycling the developing device.

Description of the Related Art

Electrophotographic image forming apparatuses (image forming apparatuses) refer to apparatuses for forming an image on a recording medium using an electrophotographic imaging forming process. Examples of image forming apparatuses include electrophotographic copiers, electrophotographic printers (e.g., light emitting diode (LED) printers, and laser beam printers), facsimiles, and word processors.

A developing device includes a developing unit which acts on an electrophotographic photosensitive member (photosensitive member). The developing device may be configured as a cartridge detachably from and attachably to the apparatus main body of an image forming apparatus.

The cartridge is configured to be detachably from and attachably to the apparatus main body of an image forming apparatus. Examples of cartridges include process cartridges. A process cartridge refers to a cartridge including a photosensitive member and a process unit which acts on the photosensitive member. Examples of process units include developing units, charging units, and cleaning units. Other examples of the cartridge include cartridges having a developing unit (developing cartridge). In such a cartridge system, maintenance of the image forming apparatus can be done by changing the cartridges.

A developing device wears in the course of developing an electrostatic latent image on a photosensitive member by using a developer. When the developing device wears to such an extent that it can no longer form an image having a satisfactory image quality for a user, the life of the developing device ends.

A developing device that has come to the end of its life may be remerchandised. Japanese Patent Application Laid-Open No. 2009-288286 discusses a method for refilling a cartridge with a developer, replacing various parts, and cleaning parts with developer adhering thereto.

Japanese Patent Application Laid-Open No. 2009-288286 discusses a cartridge in which a regulation member (developing blade) for regulating a developer is fixed to a frame by using fixing members (screws). The developing blade is removed from the frame after removing the screws.

Japanese Patent Application Laid-Open No. 2017-156474 discusses a method for fixing a collecting member to a developing blade, thus preventing leak of the developer. The collecting member has a storage portion for storing a developer scattered from the developing blade.

SUMMARY OF THE DISCLOSURE

A developing device may include a regulation member for regulating a developer, fixed to a frame by a fixing member, and a cover member attached to the regulation member so as to cover the fixing member.

An aspect of the present disclosure is directed to offering a method for disassembling a developing device including a regulation member and a cover member. The regulation member is configured to regulate a developer, and is fixed to a frame of the developing device with a fixing member. The cover member is attached to the regulation member so as to cover the fixing member. More specifically, the present disclosure is directed to offering a method for removing the regulation member from the frame even if the cover member covers the fixing member.

According to an aspect of the present disclosure, there is provided a method for disassembling a developing device. The developing device includes a frame configured to store a developer, a developer bearing member configured to bear the developer, the developer bearing member being rotatably supported by the frame, a regulation member including a regulation portion configured to regulate the developer borne by the developer bearing member, and a supporting portion configured to support the regulation portion, a fixing member configured to fix the regulation member to the frame, the fixing member having a holding portion configured to hold the regulation member, the holding portion being disposed so that the regulation member is sandwiched between the holding portion and the frame, and a cover member having a cover portion attached to the regulation member and configured to cover at least a part of the holding portion. The disassembling method includes cover removing for removing at least a part of the cover portion to reduce the size of a region of the holding portion covered by the cover portion, removing the fixing member from the frame, and removing the regulation member from the frame.

Further features and aspects of the present disclosure will become apparent from the following description of example embodiments with reference to the attached drawings.

DESCRIPTION OF THE EMBODIMENTS

First Example Embodiment (Overall Configuration of Example Image Forming Apparatus)

Figure 2:
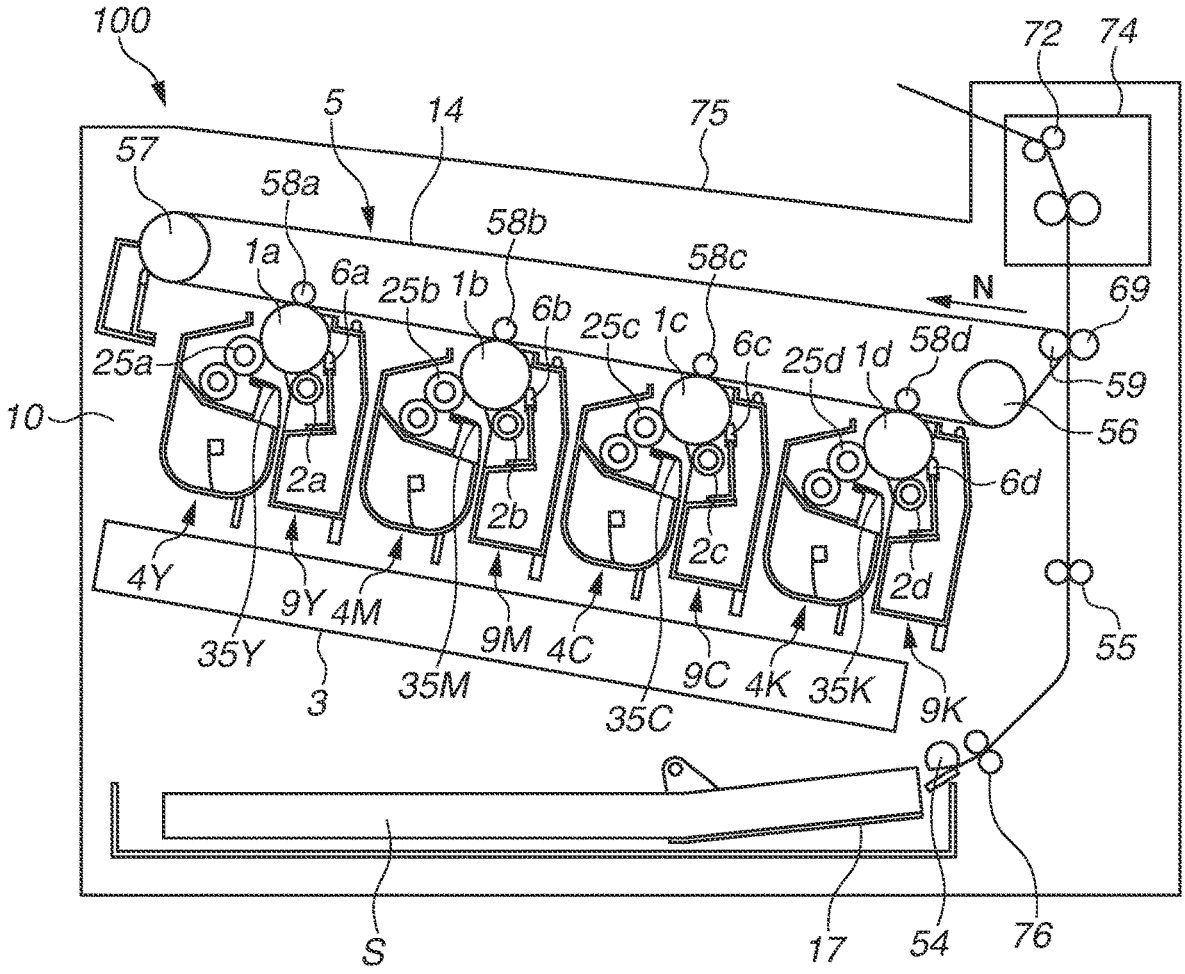
FIG. 2 is a cross-sectional view illustrating an image forming apparatus according to the first example embodiment.

Firstly, an overall configuration of an electrophotographic image forming apparatus (hereinafter referred to as an image forming apparatus) 100 will be described below with reference to FIG. 2. FIG. 2 is a cross-sectional view schematically illustrating the image forming apparatus 100 according to a first example embodiment.

As illustrated in FIG. 2, drum cartridges as photosensitive member units and developing cartridges as developing devices are attached to an apparatus main body 10 of the image forming apparatus 100. According to the present example embodiment, four drum cartridges 9Y, 9M, 9C, and 9K (drum cartridges 9) and four developing cartridges 4Y, 4M, 4C, and 4K (developing cartridges 4) are attached to the apparatus main body 10. The drum cartridges 9 and the developing cartridges 4 are configured to be detachably from and attachably to the apparatus main body 10.

As illustrated in FIG. 2, the drum cartridges 9 and the developing cartridges 4 are disposed to be inclined relative to the horizontal direction in a state of being attached to the apparatus main body 10.

The drum cartridges 9Y, 9M, 9C, and 9K include electrophotographic photosensitive members (hereinafter referred to as photosensitive drums) 1*a*, 1*b*, 1*c*, and 1*d*, respectively, as image bearing members for bearing electrostatic latent images. Process units including charging rollers 2*a*, 2*b*, 2*c*, and 2*d* (charging rollers 2) as charging members are disposed around the photosensitive drums 1*a*, 1*b*, 1*c*, and 1*d* (photosensitive drums 1), respectively. Cleaning members 6*a*, 6*b*. 6*c*, and 6*d* (cleaning members 6) are disposed around the photosensitive drums 1*a*, 1*b*, 1*c*, and 1*d*, respectively. The charging rollers 2*a*, 2*b*, 2*c*, and 2*d* charges a surface of the photosensitive drums 1*a*, 1*b*, 1*c*, and 1*d*, respectively. As discussed below, electrostatic latent images formed on the photosensitive drums 1 (1*a*, 1*b*, 1*c*, and 1*d*) are developed by toner as a developer, and toner images are formed on the photosensitive drums 1 (1*a*, 1*b*, 1*c*, and 1*d*). After toner images formed on the photosensitive drums 1*a*, 1*b*, 1*c*, and 1*d* have been transferred to a recording medium S, the cleaning members 6*a*, 6*b*, 6*c*, and 6*d* remove toner remaining on the photosensitive drums 1*a*, 1*b*, 1*c*, and 1*d*, respectively.

The developing cartridges 4Y, 4M, 4C, and 4K (developing cartridges 4) include developing rollers 25*a*, 25*b*, 25*c*, and 25*d* (developing rollers 25) as developer bearing members for bearing toner, respectively. The developing cartridges 4Y, 4M, 4C, and 4K (developing cartridges 4) include developing blades 35Y, 35M, 35C, and 35K (developing blades 35) as regulation members, respectively. Electrostatic latent images formed on the photosensitive drums 1*a*, 1*b*, 1*c*, and 1*d* (photosensitive drums 1) are developed by the developing rollers 25*a*, 25*b*, 25*c*, and 25*d* (developing rollers 25), respectively. Thus, toner images of respective colors are formed on the photosensitive drums 1 (1*a*, 1*b*, 1*c*, and 1*d*).

According to the example embodiment, the drum cartridges 9Y, 9M, 9C, and 9K (drum cartridges 9) are configured to be detachably from and attachably to the apparatus main body 10 along the axial line direction of the photosensitive drums 1*a*, 1*b*, 1*c*, and 1*d* (photosensitive drums 1), respectively. The developing cartridges 4Y, 4M, 4C, and 4K (developing cartridges 4) are configured to be detachably from and attachably to the apparatus main body 10 along the axial line direction of the developing rollers 25*a*, 25*b*, 25*c*, and 25*d* (developing rollers 25), respectively. In the attachment direction of the drum cartridges 9 and the developing cartridges 4, the upstream side is defined as the front side, and the downstream side is defined as the rear side.

The apparatus main body 10 includes a scanner unit 3 as an exposure apparatus. The scanner unit 3 is disposed below the drum cartridges 9 and the developing cartridges 4. The photosensitive drums 1*a*, 1*b*, 1*c*, and 1*d* (photosensitive drums 1) charged by the charging rollers 2*a*, 2*b*, 2*c*, and 2*d* (charging rollers 2) are exposed by the scanner unit 3. Thus, electrostatic latent images corresponding to image information are formed on the photosensitive drums 1*a*, 1*b*, 1*c*, and 1*d* (photosensitive drums 1).

A cassette 17 storing recording media S, such as paper, is attached to the apparatus main body 10. The cassette 17 is disposed under the scanner unit 3.

The apparatus main body 10 includes a feed roller 54, a conveyance roller pair 76, and a registration roller pair 55. The feed roller 54 separates the recording media S stored in the cassette 17 and feeds the media one by one. The conveyance roller pair 76 conveys the fed recording medium S. The registration roller pair 55 synchronizes the electrostatic latent images formed on the photosensitive drums 1 with the recording medium S.

An intermediate transfer unit 5 as an intermediate transfer member is also attached to the apparatus main body 10. The intermediate transfer unit 5 is disposed above the drum cartridges 9 and the developing cartridges 4. Toner images formed on each of the photosensitive drums 1*a*, 1*b*, 1*c*, and 1*d* (photosensitive drums 1) are transferred to the intermediate transfer unit 5. The intermediate transfer unit 5 includes a drive roller 56, a driven roller 57, primary transfer rollers 58*a*, 58*b*, 58*c*, and 58*d* (primary transfer rollers 58), and a facing roller 59. The intermediate transfer unit 5 further includes a transfer belt 14.

The primary transfer rollers 58*a*, 58*b*, 58*c*, and 58*d* are disposed at positions facing the photosensitive drums 1*a*, 1*b*, 1*c*, and 1*d*, respectively. The facing roller 59 is disposed at a position facing a second transfer roller 69 (described below). During the image forming operation, the transfer belt 14 circularly moves in the direction of an arrow N (indicated in FIG. 2) while facing and contacting the photosensitive drums 1*a*, 1*b*, 1*c*, and 1*d* (photosensitive drums 1).

When the primary transfer rollers 58*a*, 58*b*, 58*c*, and 58*d* (transfer rollers 58) are applied with a voltage, toner images are transferred from the photosensitive drums 1*a*, 1*b*, 1*c*, and 1*d* (photosensitive drums 1) to the transfer belt 14, respectively. When the facing roller 59 and the second transfer roller 69 are applied with a voltage, a toner image is transferred from the transfer belt 14 to the recording medium S.

The apparatus main body 10 further includes a fixing unit 74. The recording medium S with the toner image formed thereon is upwardly conveyed and then pressurized and heated by the fixing unit 74. The toner image is fixed to the recording medium S and then discharged to a discharge unit 75 by a discharging roller 72.

(Example Attaching Drum Cartridge and Developing Cartridge)

Figure 3:
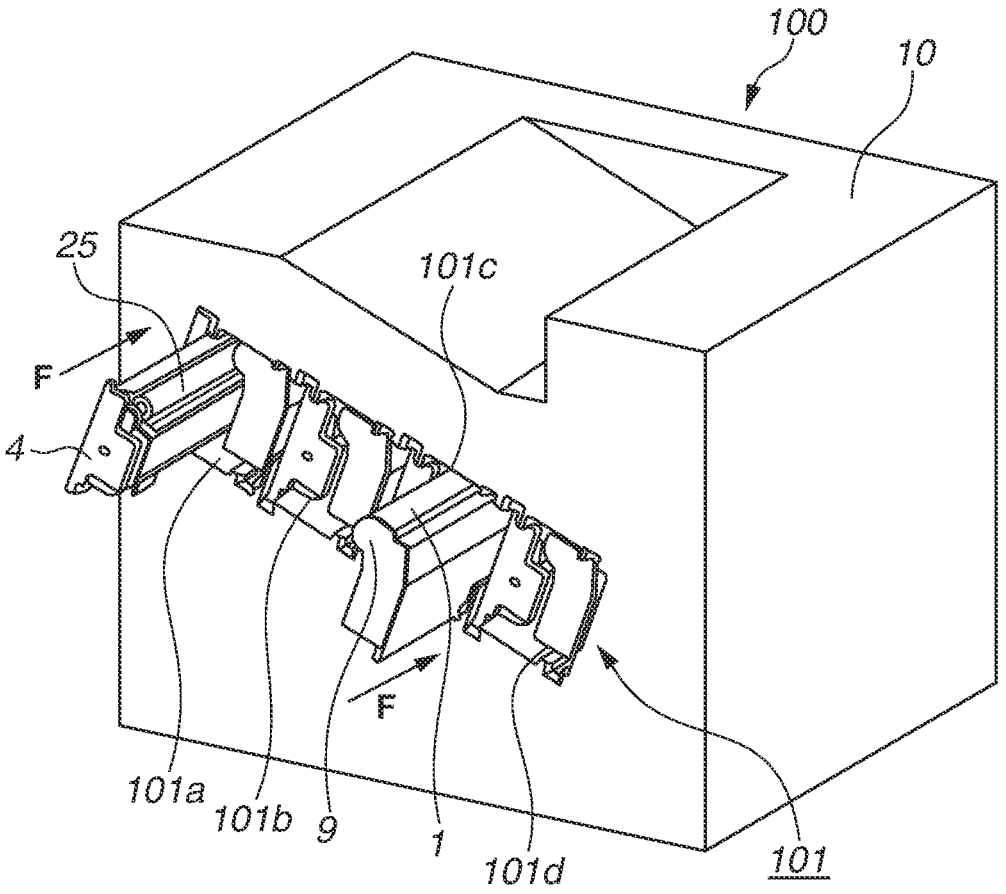
FIG. 3 illustrates an attachment of a drum cartridge and a developing cartridge according to the first example embodiment.

A configuration where a drum cartridge 9 and a developing cartridge 4 are inserted into the apparatus main body 10 of the image forming apparatus 100 will be described below with reference to FIG. 3. FIG. 3 illustrates the attachment of the drum cartridge 9 and the developing cartridge 4.

The drum cartridges 9Y, 9M, 9C, and 9K (drum cartridges 9) are inserted into openings 101*a*, 101*b*, 101*c*, and 101*d* (openings 101) of the apparatus main body 10, respectively. The developing cartridges 4Y, 4M, 4C, and 4K (developing cartridges 4) are inserted into openings 101*a*, 101*b*, 101*c*, and 101*d* of the apparatus main body 10, respectively. The drum cartridges 9 (9Y, 9M, 9C, and 9K) and the developing cartridges 4 (4Y, 4M, 4C, and 4K) are inserted from a near side to a depth side in a direction indicated by an arrow F illustrated in FIG. 3. The drum cartridges 9 are inserted in parallel to the rotation axis direction of the photosensitive drums 1*a*, 1*b*, 1*c*, and 1*d* (photosensitive drums 1) as described below. The developing cartridges 4 are inserted in parallel to a rotation axis direction of the developing rollers 25 (described below).

According to the example embodiment, the developing cartridges 4 and the drum cartridges 9 can be detachably from and attachably to the apparatus main body 10 independently of each other. In a state where the developing cartridges 4 and the drum cartridges 9 are attached to the apparatus main body 10, the rotation axis direction of the developing rollers 25 and the rotation axis direction of the photosensitive drums 1 are parallel to each other.

(Example Drum Cartridges)

Figure 4:
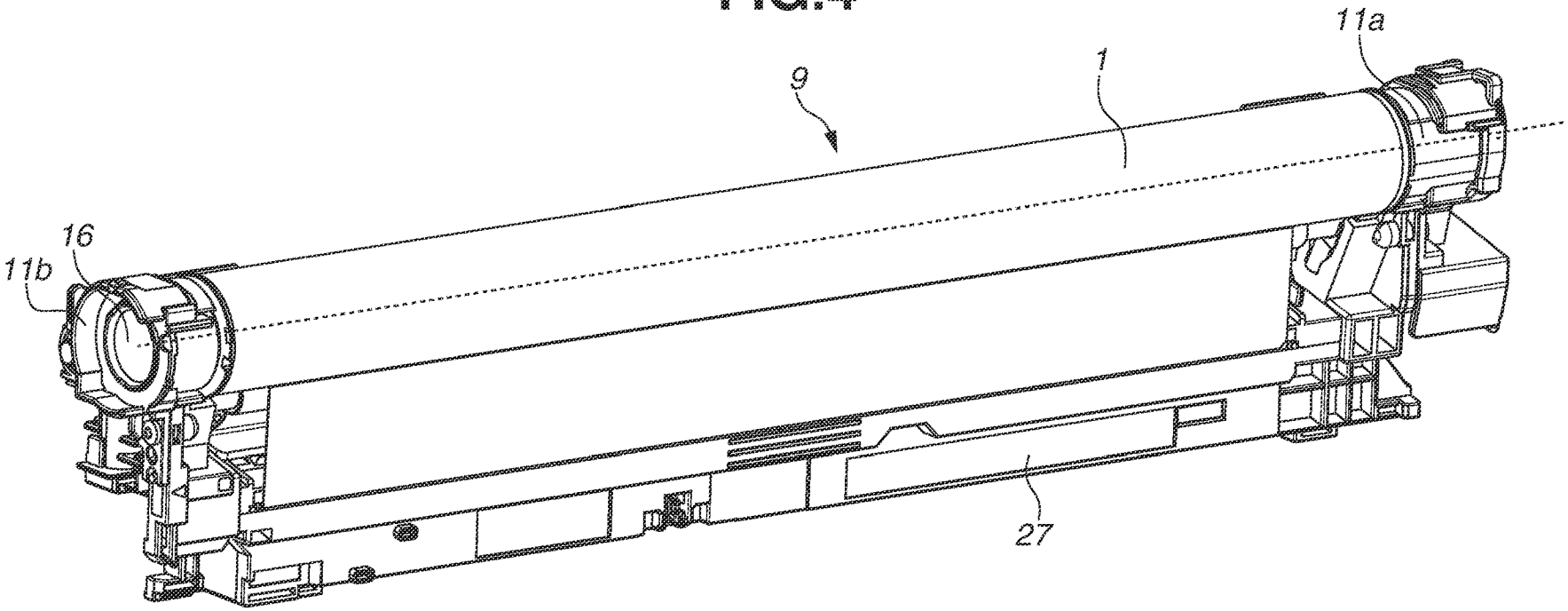
FIG. 4 is a perspective view illustrating a drum cartridge according to the first example embodiment.
Figure 5:
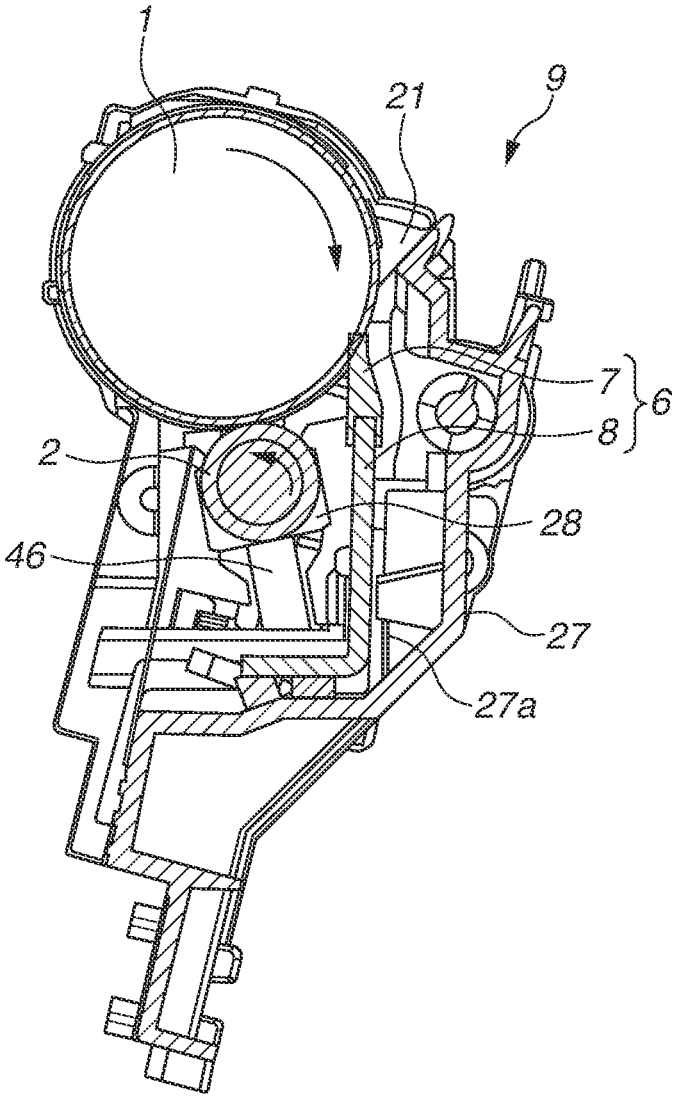
FIG. 5 is a cross-sectional view illustrating the drum cartridge according to the first example embodiment.

The drum cartridges 9Y. 9M, 9C, and 9K (drum cartridges 9) will be described below with reference to FIGS. 4 and 5. FIG. 4 is a perspective view schematically illustrating a drum cartridge 9. FIG. 5 is a cross-sectional view illustrating the drum cartridge 9. More specifically, FIG. 5 is a cross-sectional view illustrating the drum cartridge 9 in the direction perpendicularly intersecting with the rotation axis direction of a photosensitive drum 1. More specifically, FIG. 5 illustrates a cross section of the drum cartridge 9 in the direction perpendicular to the rotation axis direction of the photosensitive drum 1, when viewed along the rotation axis direction of the photosensitive drum 1. According to the example embodiment, the drum cartridges 9Y, 9M, 9C, and 9K have an identical configuration. Thus, the following descriptions will be made centering on one of the drum cartridges 9.

As illustrated in FIG. 4, the drum cartridge 9 includes a drum frame 27. The photosensitive drum 1 is rotatably supported by the drum frame 27 via a first drum bearing 11*a* and a second drum bearing 11*b*. The photosensitive drum 1 is rotatable around the rotation axis drawn with a broken line. A drum coupling 16 for receiving the drive from the apparatus main body 10 is provided at one end of the photosensitive drum 1 in the rotation axis direction (longitudinal direction).

As illustrated in FIG. 5, a charging roller 2 and cleaning members 6 are disposed around the photosensitive drum 1. The cleaning members 6 include an elastic member 7 formed of a rubber blade, and a cleaning supporting member 8. In the image forming operation, the photosensitive drum 1 rotates in the direction indicated by the arrow illustrated in FIG. 5. The elastic member 7 comes in contact with the photosensitive drum 1 in the counter direction of the rotational direction. Residual toner removed from the photosensitive drum 1 by the cleaning members 6 drops into a residual toner chamber 27*a* of the drum frame 27.

As illustrated in FIG. 5, a sealing sheet 21 is provided with the drum frame 27, and is in contact with the photosensitive drum 1. The sealing sheet 21 prevents residual toner in the residual toner chamber 27*a* from leaking from the gap between the drum frame 27 and the photosensitive drum 1.

When the driving force of an apparatus main body drive motor (not illustrated) as a drive source is transmitted to the drum coupling 16 of the drum cartridge 9, the photosensitive drum 1 rotates according to the image forming operation. As illustrated in FIG. 5, the charging roller 2 is rotatably supported by the drum frame 27 via a charging roller bearing 28. The charging roller 2 is pressed onto the photosensitive drum 1 by the pressing member 46 and is rotated by the photosensitive drum 1 (in the direction of the arrow illustrated in FIG. 5).

(Example Developing Cartridges)

Figure 6:
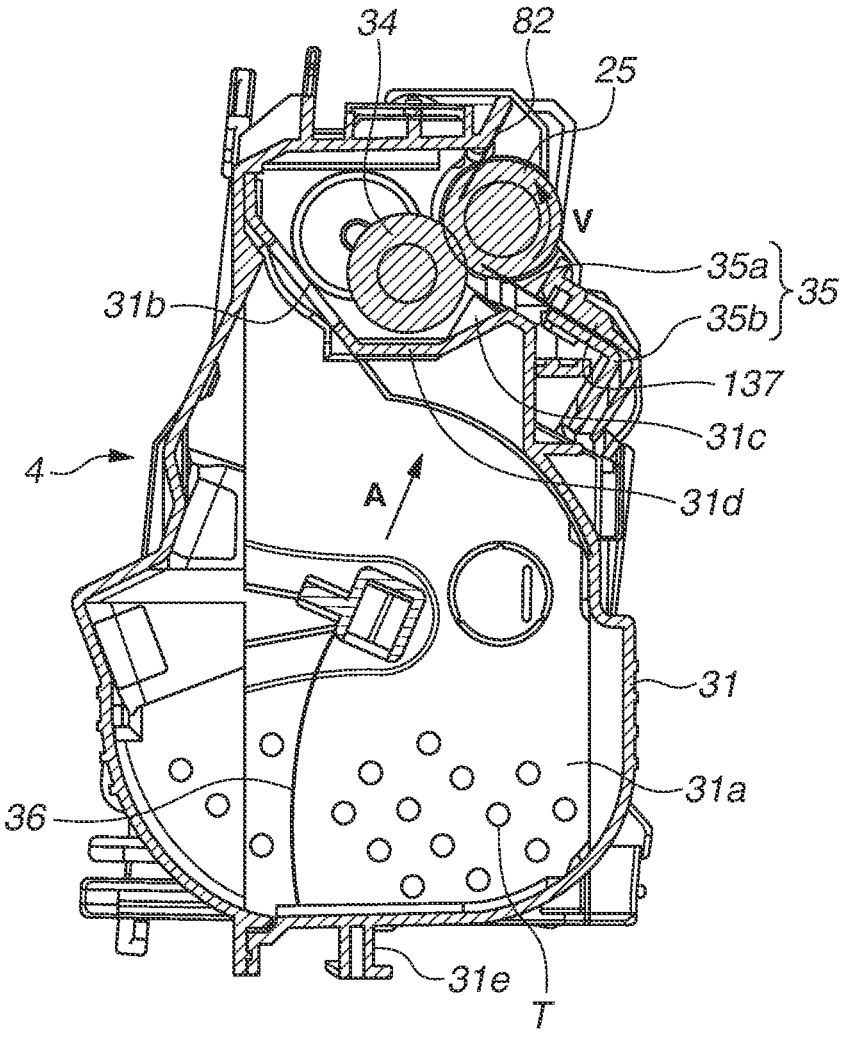
FIG. 6 is a cross-sectional view illustrating a developing cartridge according to the first example embodiment.
Figure 7:
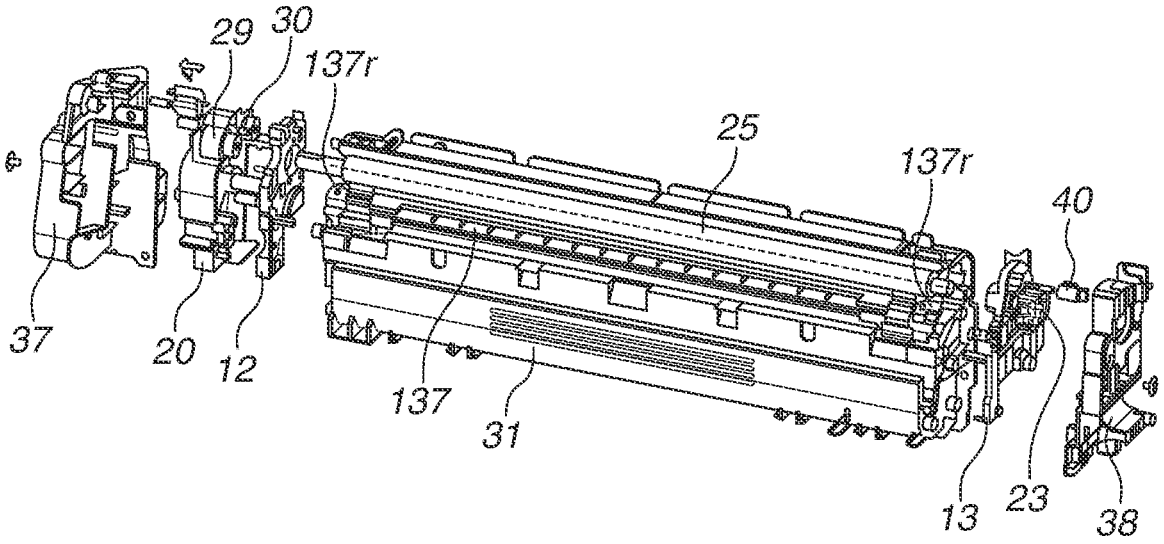
FIG. 7 is a perspective view illustrating the developing cartridge according to the first example embodiment.

The developing cartridges 4Y, 4M, 4C, and 4K (developing cartridges 4) will be described below with reference to FIGS. 6 and 7. FIG. 6 is a cross-sectional view illustrating a developing cartridge 4. More specifically, FIG. 6 is a cross-sectional view illustrating the developing cartridge 4 in the direction perpendicular to (orthogonal direction) the rotation axis direction of a developing roller 25. More specifically, FIG. 6 illustrates a cross section of the developing cartridge 4 in the direction perpendicular to the rotation axis direction of the developing roller 25, when viewed along the rotation axis direction of the developing roller 25. FIG. 7 is a perspective view illustrating the developing cartridge 4.

The developing cartridge 4Y storing yellow toner, the developing cartridge 4M storing magenta toner, the developing cartridge 4C storing cyan toner, and the developing cartridge 4K storing black toner have an identical configuration. Thus, the following descriptions will be made centering on one of the developing cartridges 4. In the following descriptions, toner is not distinguished by color and simply referred to as toner T.

The developing cartridge 4 includes a developing frame 31 as a frame, a developing roller 25, a toner feed roller 34 rotating in contact with the developing roller 25, a developing blade 35 for regulating a toner layer on the developing roller 25, and a toner conveyance member 36. The toner T is stored in the developing frame 31. The developing roller 25, the toner feed roller 34, the developing blade 35, and the toner conveyance member 36 are rotatably supported by the developing frame 31. The developing blade 35 is fixed to the developing frame 31. In the image forming operation, the developing roller 25 rotates in the direction of an arrow V illustrated in FIG. 7. The toner feed roller 34 rotates in contact with the developing roller 25.

The developing frame 31 includes a developing chamber 31*c*, and a toner storage chamber 31*a* disposed under the developing chamber 31*c*. The developing roller 25 and the toner feed roller 34 are disposed in the developing chamber 31*c*. The developing chamber 31*c* and the toner storage chamber 31*a* are separated by a partition 31*d*. The partition 31*d* is provided with a toner opening 31*b* through which toner being conveyed from the toner storage chamber 31*a* to the developing chamber 31*c* passes.

A sealing sheet 82 is attached to the developing frame 31. The sealing sheet 82 prevents the toner T from leaking from a gap between the developing frame 31 and the developing roller 25. The developing roller 25 is exposed to the outside of the developing frame 31 at a position on the downstream side of the developing blade 35 and on the upstream side of the sealing sheet 82 in the rotational direction of the developing roller 25. The developing roller 25 comes in contact with the photosensitive drum 1 at a portion exposed from the developing frame 31. A portion on the downstream side of the developing blade 35 and on the upstream side of the sealing sheet 82 in the rotational direction of the developing roller 25 may be referred to as an exposed portion of the developing roller 25.

The developing frame 31 is provided with an urged portion 31*e*. The urged portion 31*e* is urged by an urging member (not illustrated) provided on the apparatus main body 10. Accordingly, the developing frame 31 can move between the position where the developing roller 25 comes into contact with the photosensitive drum 1 and the position where the developing roller 25 separates from the photosensitive drum 1.

As illustrated in FIG. 6, the toner storage chamber 31*a* of the developing frame 31 includes a toner conveyance member 36 for stirring the stored toner and conveying the toner to the developing chamber 31*c* via the toner opening 31*b*.

As illustrated in FIG. 7, the developing roller 25 is rotatably supported by a first developing bearing 12 and a second developing bearing 13 disposed at both ends of the developing frame 31 in the rotation axis direction of the developing roller 25. The toner feed roller 34 is also rotatably supported by the first developing bearing 12 and the second developing bearing 13. The first developing bearing 12 and the second developing bearing 13 may be parts of the developing frame 31.

A developing coupling 23 as a driven member is provided at the end of the side where the second developing bearing 13 of the developing frame 31 is disposed. The developing coupling 23 attached to the toner feed roller 34 is rotated by the drive from the apparatus main body 10. The toner feed roller 34 is attached with a toner supply gear 30. The developing roller 25 is attached with a developing gear 29 engaging with the toner supply gear 30. Thus, the toner feed roller 34 and the developing roller 25 are rotated, when the developing coupling 23 is rotated. When the developing cartridge 4 is mounted on the apparatus main body 10, the developing coupling 23 is positioned on the downstream side of the toner supply gear 30 and the developing gear 29.

A side cover 20 as a part of the developing frame 31 is provided outside the developing gear 29 and toner supply gear 30.

The developing cartridge 4 includes a first end member 37 and a second end member 38. The second end member 38 is rotatably attached to the second developing bearing 13. The rotation of the second end member 38 is regulated by a locking member 40, before the developing cartridge 4 is mounted to the apparatus main body 10. The locking member 40 is unlocked when the developing cartridge 4 is attached to the apparatus main body 10. If the locking member 40 is unlocked, the second end member 38 is rotatable with respect to the second developing bearing 13. The first end member 37 is rotatably attached to the side cover 20. According to the present example embodiment, the rotation axes of the first end member 37 and the second end member 38 are parallel to the rotation axis of the developing roller 25.

The first end member 37 and the second end member 38 are independently rotatable with respect to the developing frame 31. More specifically, the first end member 37 is rotatable with respect to the second end member 38 and the developing frame 31, and the second end member 38 is rotatable with respect to the first end member 37 and the developing frame 31.

The first end member 37 and the second end member 38 are positioned in contact with the apparatus main body 10. Accordingly, the developing roller 25 can move between the position where the developing roller 25 comes into contact with the photosensitive drum 1 and the position where the developing roller 25 separates from the photosensitive drum 1 in a state where the developing cartridge 4 is attached to the apparatus main body 10.

As illustrated in FIG. 6, the developing blade 35 includes a regulation portion 35*a*, and a supporting portion 35*b* for supporting the regulation portion 35*a*. In other words, the regulation portion 35*a* is attached to the supporting portion 35*b*. The regulation portion 35*a* contacts the developing roller 25 to regulate the toner T borne by the developing roller 25. Thus, a toner layer having a uniform thickness is formed on the surface of the developing roller 25. The supporting portion 35*b* is fixed to the developing frame 31. According to the present example embodiment, a part of the regulation portion 35*a* of the developing blade 35 is disposed vertically below the developing roller 25. According to the example embodiment, the regulation portion 35*a* is welded to the supporting portion 35*b*. The regulation portion 35*a* may be attached to the supporting portion 35*b* with other methods.

(Example Toner Collecting Member)

Next, a collecting member included in the developing cartridge 4 will be described with reference to FIGS. 8, 9, 10, 11, and 12.

Figure 8A:
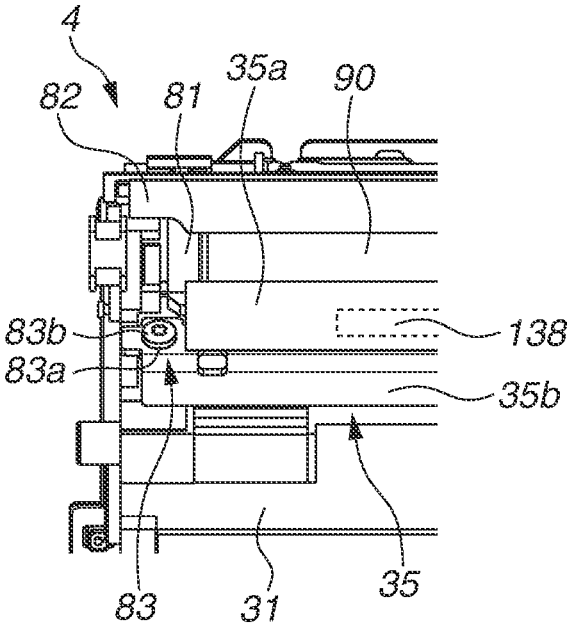
FIGS. 8A and 8B are partial enlarged views illustrating the developing cartridge according to the first example embodiment.
Figure 8B:
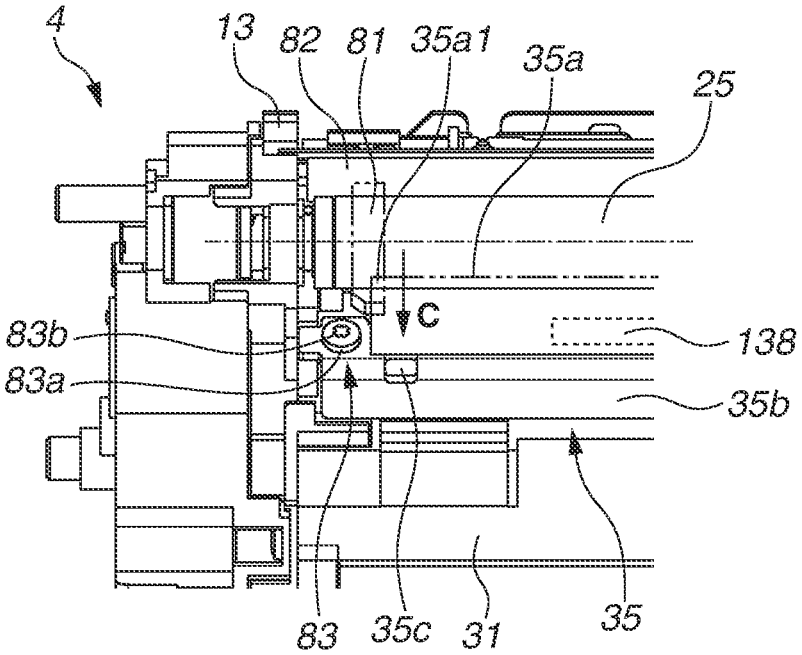
Figure 9:
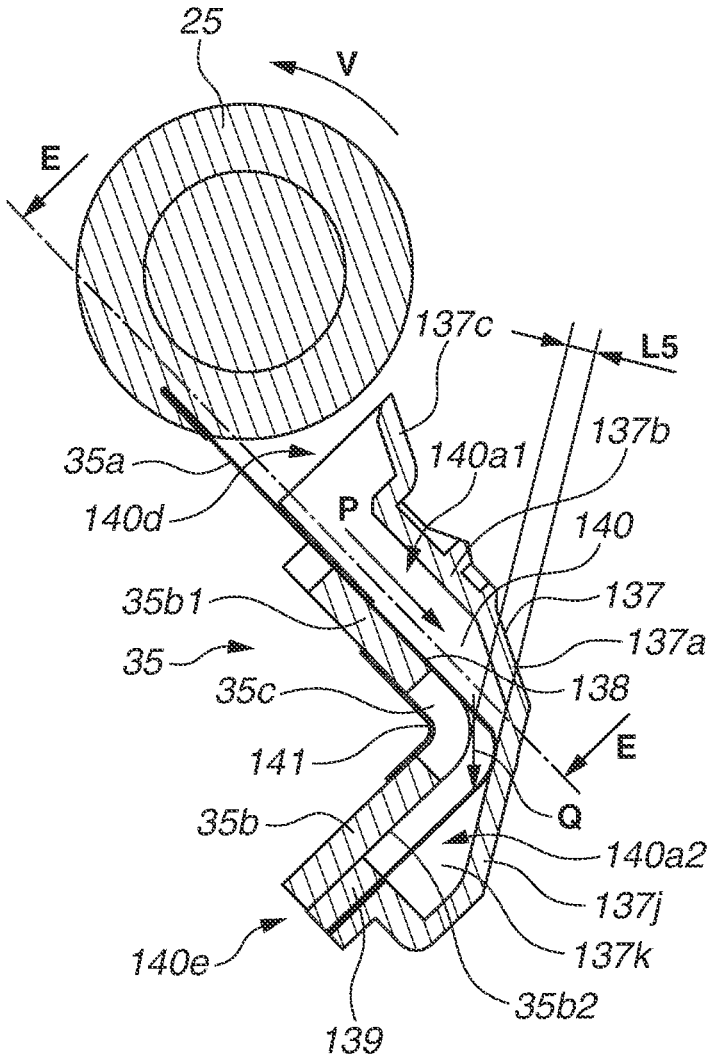
FIG. 9 is a cross-sectional view illustrating the developing cartridge in the vicinity of a collecting member according to the first example embodiment.
Figure 10A:
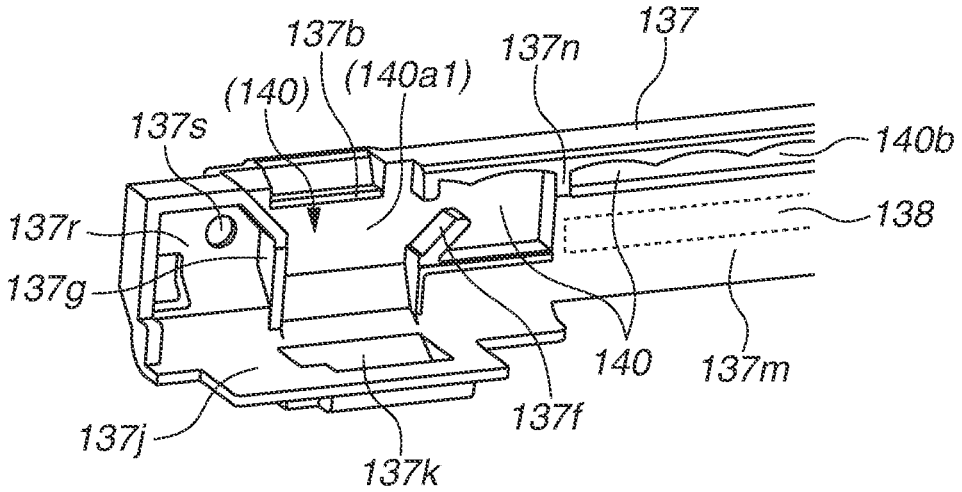
FIGS. 10A and 10B are perspective views illustrating configurations of the collecting member according to the first example embodiment.
Figure 10B:
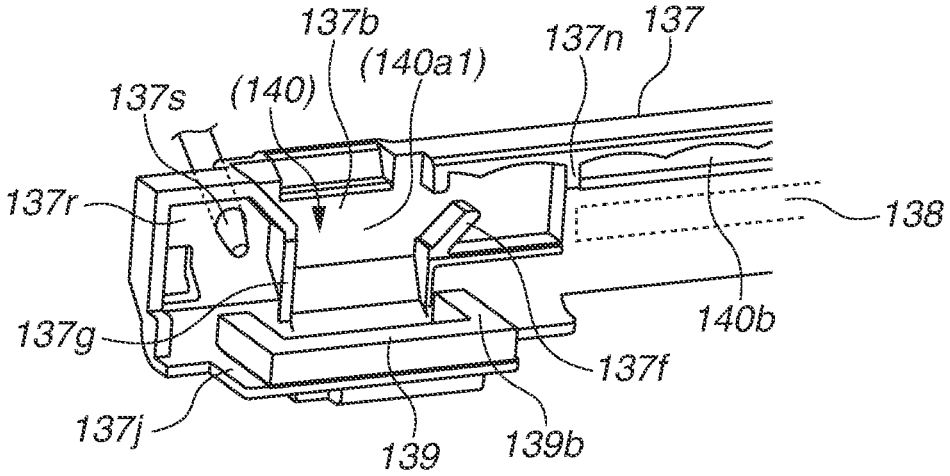
Figure 11:
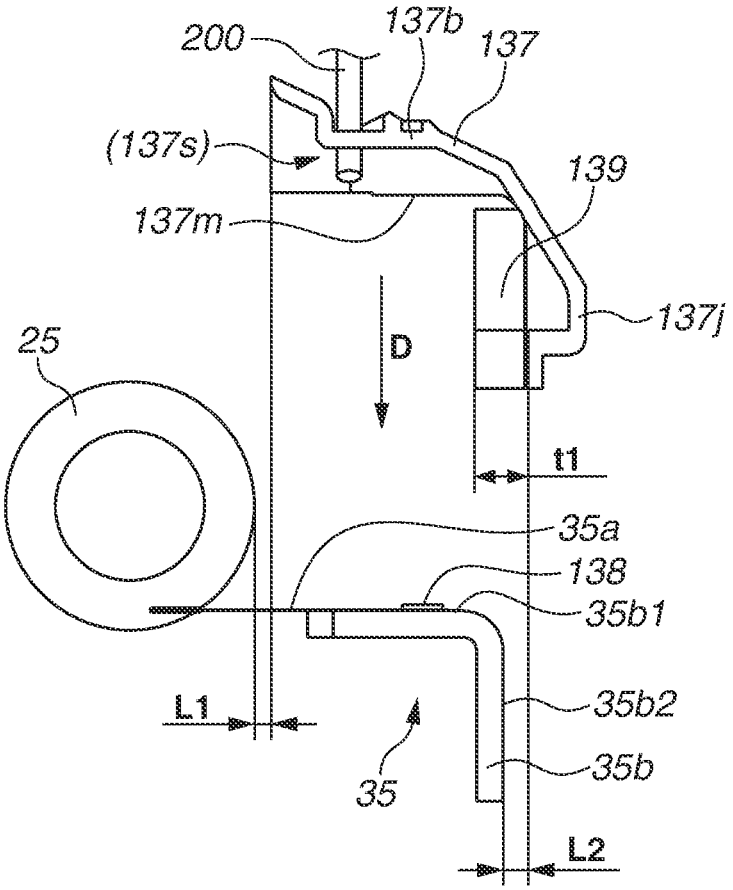
FIG. 11 is a cross-sectional view illustrating an attachment of the collecting member to a developing blade according to the first example embodiment.
Figure 12:
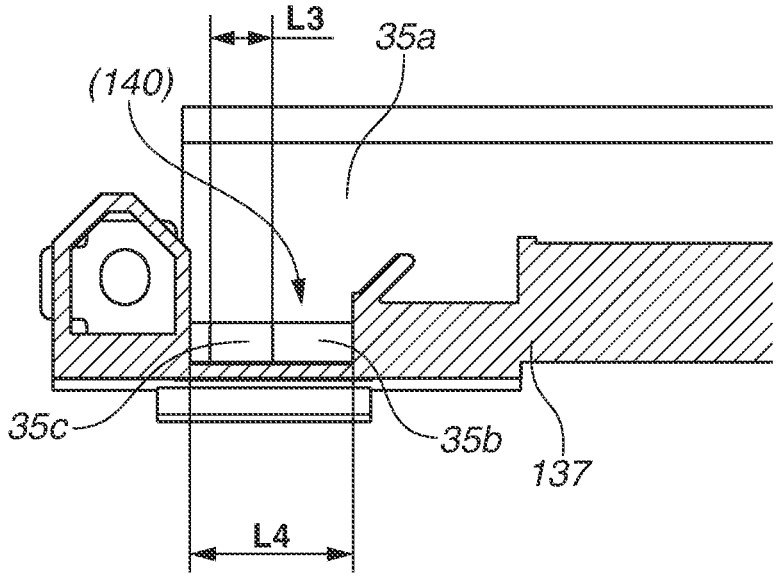
FIG. 12 illustrates a positional relation between the developing blade and the collecting member according to the first example embodiment.

FIGS. 8A and 8B are partial enlarged views illustrating the developing cartridge 4. FIG. 8A illustrates the developing cartridge 4 before the developing roller 25 is attached. FIG. 8B illustrates the developing cartridge 4 after the developing roller 25 is attached. FIG. 9 is a cross-sectional view illustrating the developing cartridge 4 in the vicinity of a collecting member 137. FIGS. 10A and 10B are perspective views illustrating a configuration of the collecting member 137. FIG. 10A illustrates the collecting member 137 when viewed from the position of the developing blade 35. FIG. 10B illustrates the attachment of an elastic sealing member 139. FIG. 11 is a cross-sectional view illustrating the attachment of the collecting member 137 to the developing blade 35. FIG. 12 illustrates a positional relation between the developing blade 35 and the collecting member 137.

FIG. 9 is illustrated based on the orientation of the developing cartridge 4 attached to the apparatus main body 10. The vertical direction of FIG. 9 is the same as the perpendicular direction (gravity direction). FIGS. 9 and 11 are cross-sectional views illustrating the developing roller 25 in the direction perpendicular to the rotation axis direction of the developing roller 25, as similar to FIG. 6. FIG. 12 is a cross-sectional view taken along the E-E line illustrated in FIG. 9.

As illustrated in FIGS. 8A and 8B, the developing cartridge 4 includes an end sealing member 81. The end sealing member 81 is attached to one end of the developing frame 31 in the longitudinal direction of the developing cartridge 4. According to the present example embodiment, the end sealing member 81 contacts the developing roller 25 to prevent the toner T from leaking from the gap between the developing roller 25 and the developing frame 31. According to the example embodiment, the longitudinal direction of the developing cartridge 4 is the same as the rotation axis direction of the developing roller 25. The end sealing member 81 is also provided at the opposite end of the developing frame 31 in the longitudinal direction of the developing cartridge 4. Consequently, a description of the opposite end of the developing frame 31 will be omitted.

The developing cartridge 4 also includes a sealing sheet 82 and the developing blade 35. The sealing sheet 82 and the regulation portion 35*a* of the developing blade 35 overlap with the end sealing member 81.

As illustrated in FIGS. 8A and 8B, the developing blade 35 is fixed to the developing frame 31 by a screw 83 as a fixing member. The screw 83 has a head 83*a* as a holding portion for holding the developing blade 35. The head 83*a* is disposed so that the developing blade 35 is sandwiched between the head 83*a* and the developing frame 31, and holds the developing blade 35 to prevent it from coming off from the developing frame 31. According to the present example embodiment, the head 83*a* contacts the supporting portion 35*b*. More specifically, the head 83*a* contacts a first portion 35*b*1 (described below).

The screw 83 can be disposed so that the head 83*a* contacts the regulation portion 35*a*. A shaft (not illustrated) is connected with the head 83*a*. The shaft is engaged with the developing frame 31 by a screw formed on the shaft. Further, a groove 83*b* is formed on the head 83*a*. The groove 83*b* is a portion into which a tool such as a screw driver is inserted.

The developing blade 35 is also fixed with a screw 83 at the opposite end of the developing frame 31 in a similar way. Consequently, a description of the opposite end of the developing frame 31 will be omitted.

According to the present example embodiment, an opening formed by the sealing sheet 82, the regulation portion 35*a* of the developing blade 35, and the end sealing member 81 is referred to as a developing opening 90. As illustrated in FIG. 8B, the developing opening 90 is sealed by the developing roller 25 when the developing roller 25 is attached to the developing opening 90. The toner T is supplied to the developing roller 25 inside the developing opening 90. When the developing roller 25 rotates, the toner T borne by the developing roller 25 is regulated by the regulation portion 35*a* and then conveyed to the outside of the developing opening 90 by the developing roller 25.

A small amount of the toner T may leak from the developing frame 31 at the portion where the developing roller 25 is exposed from the developing frame 31 on the downstream side of the developing blade 35. Meanwhile, the developing cartridge 4 includes the collecting member 137 as a cover member. If the toner T leaks, the collecting member 137 also functions as a storage member for collecting (storing) the toner T.

A regulation portion end 35*a*1 of the developing blade 35 overlaps with the end sealing member 81, and thus the contact pressure of the regulation portion 35*a* against the developing roller 25 increases at the regulation portion end 35*al*. Accordingly, the melt-adhesion of the toner T is likely to occur at the regulation portion end 35*al*. This may generate a gap between the regulation portion end 35*a*1 and the developing roller 25.

When the developing cartridge 4 rotates, an aggregate of the toner T may occur at the portion where the developing roller 25 and the end sealing member 81 rub each other. If this aggregate is caught between the regulation portion end 35*al* and the developing roller 25, a gap may occur between the regulation portion end 35*a*1 and the developing roller 25. Accordingly, the amount of leakage toner at both ends tends to be larger than that at the central portion in the longitudinal direction of the developing blade 35. The direction is equal to the longitudinal direction of the developing cartridge 4 according to the example embodiment.

As illustrated in FIG. 9, the collecting member 137 is attached to the developing blade 35. The collecting member 137 and the developing blade 35 form a collecting portion 140, which is a storage portion for storing the toner T. and a first opening 140*d*, which communicates with the collecting portion 140, between the collecting member 137 and the developing blade 35. The first opening 140*d* faces the developing roller 25 at the portion where the developing roller 25 is exposed to the outside of the developing frame 31. The collecting portion 140 is formed at one end of the collecting member 137 and the other end thereof in the longitudinal direction of the collecting member 137. The direction is equal to the longitudinal direction of the developing cartridge 4 in the example embodiment. As illustrated in FIG. 7, one end of the collecting member 137 is connected with the other end thereof.

As illustrated in FIG. 10A, a central collecting portion 140*b* as a central storage portion is formed between the collecting member 137 and the developing blade 35. The central collecting portion 140*b* is positioned inside the two collecting portions 140 in the longitudinal direction of the collecting member 137. More specifically, the collecting portion 140 is disposed at one end of the central collecting portion 140*b* and at the other end thereof. The central collecting portion 140*b* and the collecting portion 140 are partially separated by a wall 137*n*. The cross section of the collecting portion 140 is larger than the cross section of the central collecting portion 140*b* in the direction perpendicular to the longitudinal direction of the collecting member 137. The direction is equal to the direction perpendicular to the rotation axis direction of the developing roller 25 according to the example embodiment.

The gap between the collecting member 137 and the developing blade 35 at the portion where the wall 137*n* is disposed is smaller than the gap between the collecting member 137 and the developing blade 35 at the portion where the central collecting portion 140*b* and the collecting portion 140 are formed. The above configuration enables regulating the movement of the toner T in the longitudinal direction of the collecting member 137.

Further, there is provided an inclined wall 137*f* inclined toward the central portion in the longitudinal direction. When the toner T moves from the central collecting portion 140*b* to the collecting portion 140 in the longitudinal direction, the movement of the toner T is prevented by the inclined wall 137*f*.

The configurations of the collecting portion 140 and its periphery are also provided in a similar way at the opposite end of the collecting member 137 in the longitudinal direction of the developing cartridge 4. Thus, a description of the opposite end of the collecting member 137 will be omitted.

The collecting member 137 and the developing blade 35 will be described in more detail. As illustrated in FIG. 9, the supporting portion 35*b* of the developing blade 35 is provided with the first portion 35*b*1 and a second portion 35*b*2. The regulation portion 35*a* is attached to the first portion 35*b*1. The first portion 35*b*1 is fixed to the developing frame 31. The supporting portion 35*b* is bent between the first portion 35*b*1 and the second portion 35*b*2. In other words, a bending portion is formed between the first portion 35*b*1 and the second portion 35*b*2.

As illustrated in FIG. 9, the collecting member 137 includes a first receiving portion 137*b* and a second receiving portion 137*j*. The first receiving portion 137*b* and the second receiving portion 137*j* are connected with each other by a connecting portion 137*a*.

The first receiving portion 137*b* faces the first portion 35*b*1 and the regulation portion 35*a*. In other words, the first receiving portion 137*b* overlaps with the first portion 35*b*1 and the regulation portion 35*a*, and covers the first portion 35*b*1 and the regulation portion 35*a*. This forms a first storage area (e.g., first collecting area) 140*a*1 between the developing blade 35 and the first receiving portion 137*b*. In other words, the first storage area 140*a*1 is formed between the first portion 35*b*1 and the first receiving portion 137*b* and between the regulation portion 35*a* and the first receiving portion 137*b*.

The second receiving portion 137*j* faces the second portion 35*b*2. In other words, the second receiving portion 137*j* overlaps with the second portion 35*b*2, and covers the second portion 35*b*2. Thus, a second storage area (e.g., second collecting area) 140*a*2 is formed between the developing blade 35 and the second receiving portion 137*j*. In other words, the second storage area 140*a*2 is formed between the second portion 35*b*2 and the second receiving portion 137*j*.

As described above, the collecting portion 140 includes the first storage area 140*a*1 and the second storage area 140*a*2. The first opening 140*d* communicates with the first storage area 140*a*1. That is, the first opening 140*d* communicates with the collecting portion 140 and the outside of the collecting portion 140. In other words, the first opening 140*d* communicates with the first storage area 140*a*1 and the outside of the first storage area 140*a*1.

A second opening 140*e* is formed between the developing blade 35 and the second receiving portion 137*j*. More specifically, the second opening 140*e* is formed between the second portion 35*b*2 and the second receiving portion 137*j*. The second opening 140*e* is positioned on the opposite side of the first opening 140*d* in the direction perpendicular to the rotation axis direction of the developing roller 25. More specifically, the first opening 140*d* is disposed at one end of the collecting portion 140, and the second opening 140*e* is disposed at the other end of the collecting portion 140 in the direction perpendicular to the rotation axis direction of the developing roller 25. The second opening 140*e* communicates with the second storage area 140*a*2. More specifically, the second opening 140*e* communicates with the collecting portion 140 and the outside of the collecting portion 140. In other words, the second opening 140*e* communicates with the second storage area 140*a*2 and the outside of the second storage area 140*a*2.

As illustrated in FIG. 9, the collecting member 137 includes the second receiving portion 137*j* facing the second portion 35*b*2 (second surface) of the supporting portion 35*b* of the developing blade 35. The second receiving portion 137*j* having a recess 137*k* is attached with an elastic sealing member 139, as illustrated in FIG. 10B. As illustrated in FIGS. 8 and 11, the collecting member 137 is fixed to the developing blade 35 via a two-sided adhesive tape (attaching member) 138 stuck on the regulation portion 35*a* of the developing blade 35. Referring to FIG. 10A, the two-sided adhesive tape 138 is drawn with broken lines to illustrate the sticking position of the two-sided adhesive tape 138 with respect to a fixing surface 137*m*. This tape fixes the fixing surface 137*m* of the collecting member 137 to the regulation portion 35*a* of the developing blade 35. The second storage area 140*a*2 may be a space formed by the developing blade 35, the collecting member 137, and elastic sealing member 139.

As illustrated in FIG. 9, when the developing cartridge 4 is used, the toner T which leaked from the inside of the developing frame 31 streams down on the regulation portion 35*a* along an arrow P. Thereafter, the toner T drops in the direction indicated by an arrow Q by its own weight, and then is stored in the second storage area 140*a*2.

Part of the toner T which cannot be stored in the second storage area 140*a*2 is stored in the first storage area 140*a*1.

According to the present example embodiment, to collect the toner T dropping and scattering from the surface of the developing roller 25 as much as possible, a leading end 137*c* of the first receiving portion 137*b* forming the first opening 140*d* is inclined toward the downstream side in the rotational direction of the developing roller 25. Accordingly, the lower part of the developing roller 25 is widely covered by the first receiving portion 137*b*.

Further, a width L5 of the connecting portion 137*a* between the first storage area 140*a*1 and the second storage area 140*a*2 is smaller than the widths of the first storage area 140*a*1 and the second storage area 140*a*2 in the cross section direction perpendicular to the rotation axis direction of the developing roller 25. The second storage area 140*a*2 extends in the direction inclined with respect to the first storage area 140*a*1 (e.g., in the direction perpendicular to the first storage area 140*a*1 according to the present example embodiment). The above configuration prevents the toner T collected in the second storage area 140*a*2 from flowing back into the first storage area 140*a*1.

As illustrated in FIGS. 8B and 9, a hole portion 35*c* is formed in the supporting portion 35*b*. The hole portion 35*c* is blocked by a sealing tape 141 from the side opposite to the attachment side of the collecting member 137. As illustrated in FIG. 8B, the hole portion 35*c* is positioned inside the end sealing member 81 in the longitudinal direction. More specifically, the hole portion 35*c* is disposed in the vicinity of the end of the developing blade 35 where an amount of leakage toner T increases. As illustrated in FIG. 8B, the toner T passes through the hole portion 35*c* along an arrow C.

The collecting member 137 is disposed to cover the hole portion 35*c*. The position of the hole portion 35*c* and the position of the collecting portion 140 overlap with each other in the rotation axis direction of the developing roller 25. As illustrated in FIG. 12, a width L3 of the hole portion 35*c* is smaller than a width L4 of the connecting portion between the first storage area 140*a*1 and the second storage area 140*a*2. More specifically, the toner T passing through the hole portion 35*c* is easy to fall down into the second storage area 140*a*2.

Next, the attachment of the collecting member 137 to the developing blade 35 will be described with reference to FIG. 11. As illustrated in FIG. 11, the fixing surface 137*m* of the collecting member 137 is stuck on the regulation portion 35*a* of the developing blade 35 with the two-sided adhesive tape 138. The collecting member 137 is attached in direction indicated by an arrow D illustrated in FIG. 11 in a state where the elastic sealing member 139 is attached. It is preferable that a gap L1 between the collecting member 137 and the developing roller 25 is small to collect a large amount of the toner T with the collecting member 137. Meanwhile, the size of a gap L2 between the second portion 35*b*2 of the developing blade 35 and the second receiving portion 137*j* of the collecting member 137 may change because of parts clearance and errors in attachment. Thus, a thickness t1 of the elastic sealing member 139 is made larger than the gap L2 in consideration of the variation of the gap L2.

To bring the collecting member 137 close to the developing roller 25 and accurately attach the collecting member 137, an attachment guide 137*s* is provided outside the collecting portion 140 in the longitudinal direction of the developing blade 35. The direction is equal to the longitudinal direction of the collecting member 137. The attachment guide 137*s* is provided on a cover portion 137*r* (described below). The cover portion 137*r* and the collecting portion 140 are separated by a partition wall 137*g* to prevent the toner T stored in the collecting portion 140 from moving toward the cover portion 137*r*.

According to the present example embodiment, the attachment guide 137*s* is a through-hole. As illustrated in FIGS. 10B and 11, a positioning boss 200 of the assembling apparatus is engaged with the attachment guide 137*s* when the collecting member 137 is attached to the developing blade 35. This can improve the positional accuracy of the collecting member 137 with respect to the developing roller 25 and reduce the variation of the gap L1 illustrated in FIG. 11.

According to the present example embodiment, the attachment guide 137*s* is disposed at both ends of the collecting member 137 in the longitudinal direction. According to the present example embodiment, the attachment guide 137*s* disposed at one end in the longitudinal direction of the developing blade 35, which is equal to the longitudinal direction of the collecting member 137, is a round hole. The attachment guide 137*s* disposed on the other end in the longitudinal direction is an oblong hole.

(Methods for Disassembling and Recycling Developing Cartridge)

Figure 1:
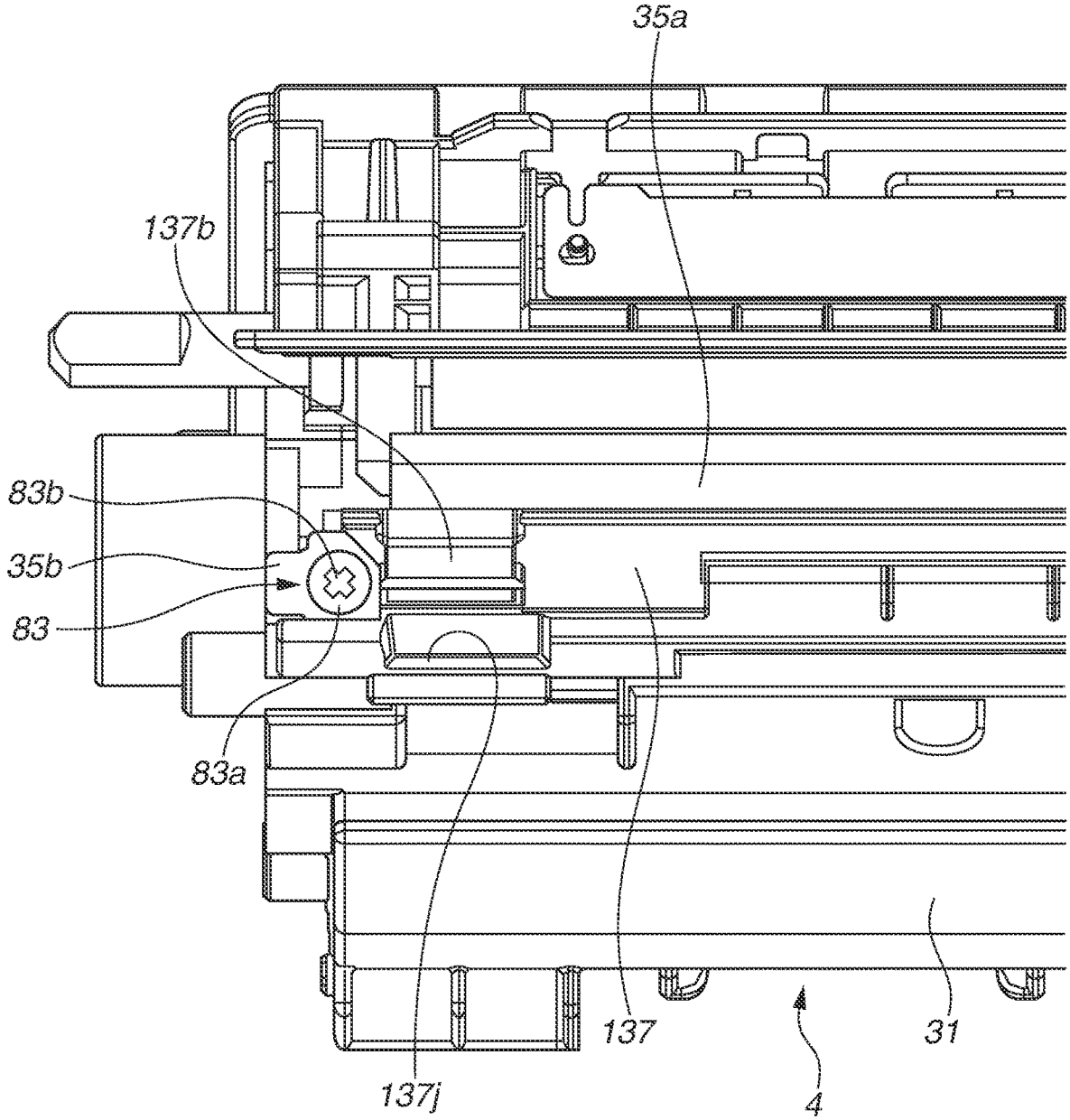
FIG. 1 is a partial enlarged view illustrating a developing cartridge with a cover portion removed according to a first example embodiment.
Figure 13:
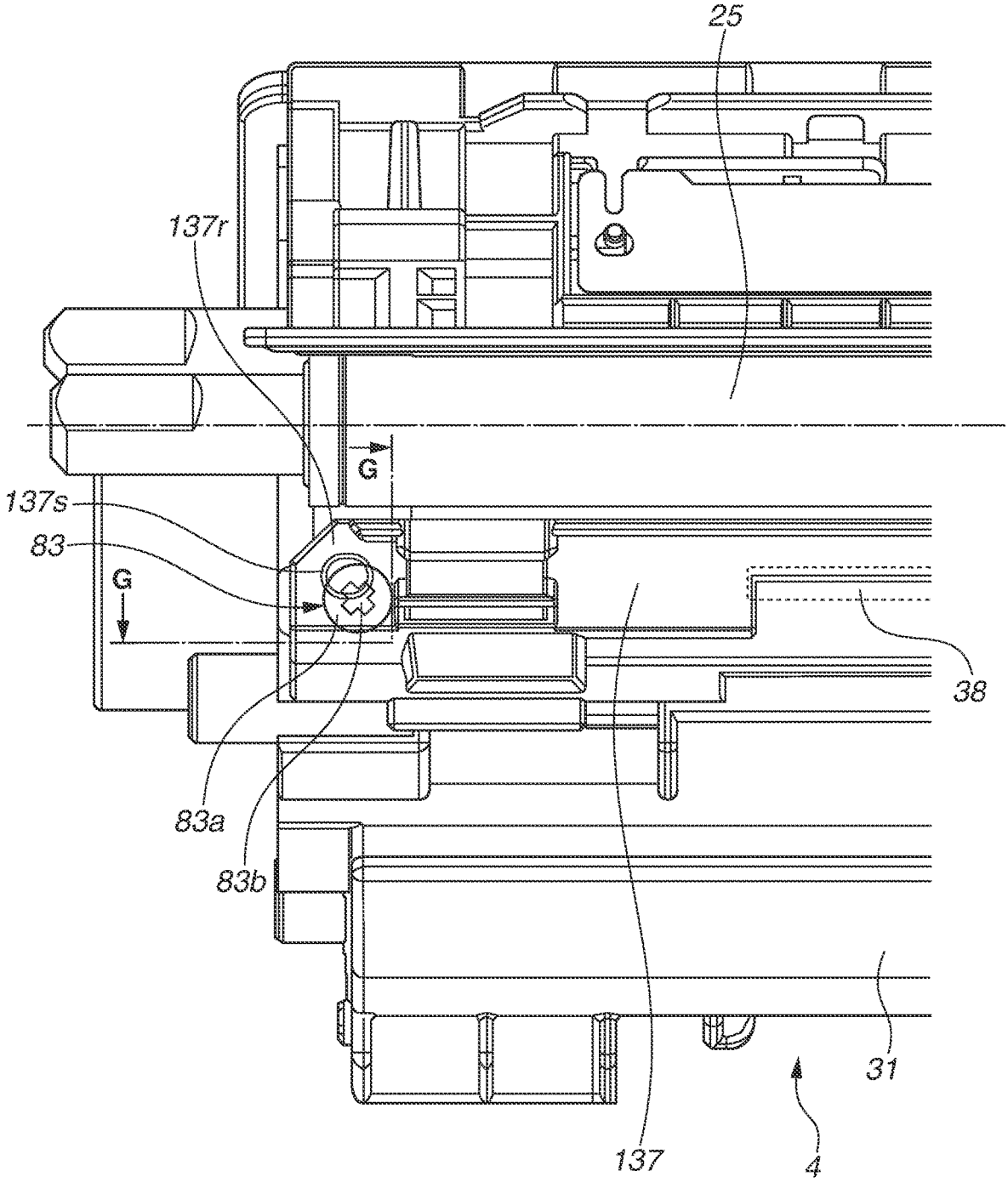
FIG. 13 illustrates a removal range of the cover portion according to the first example embodiment.
Figure 14:
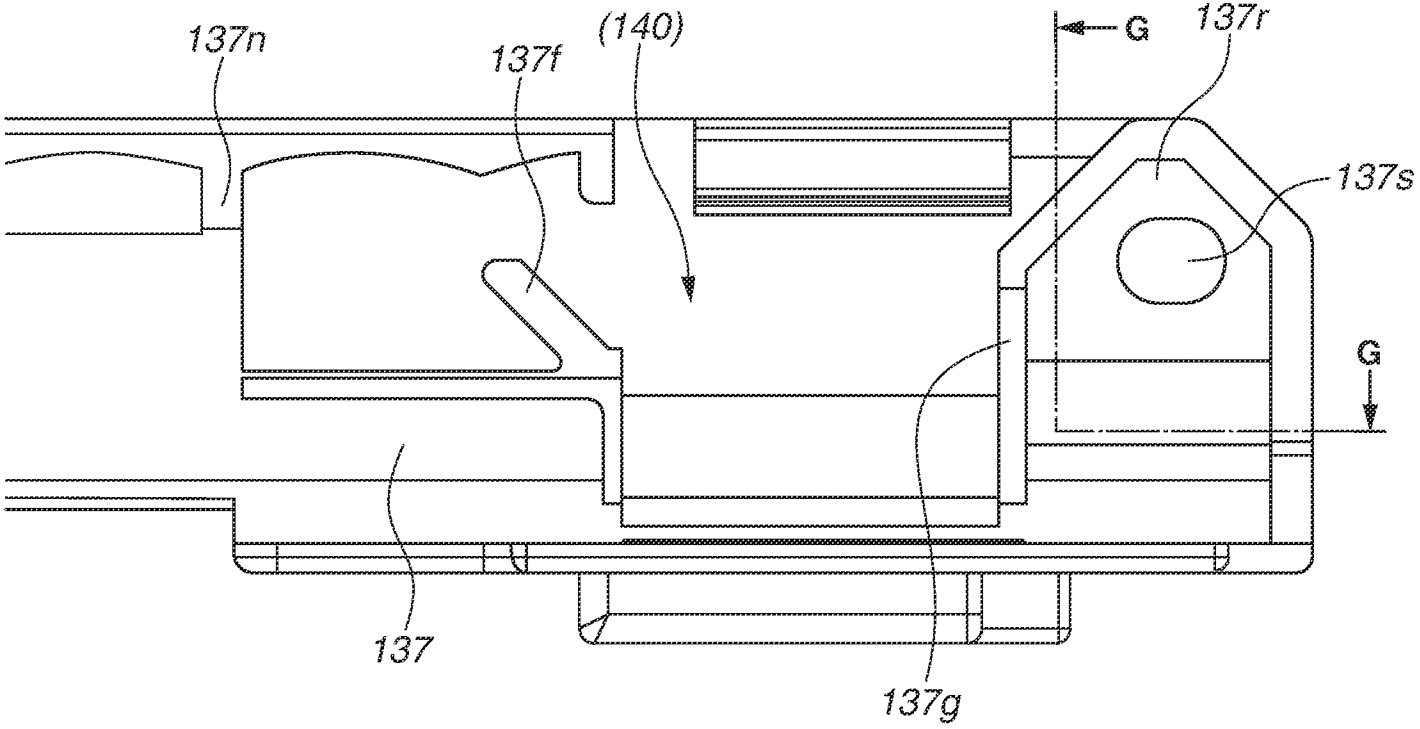
FIG. 14 illustrates the removal range of the cover portion according to the first example embodiment.
Figure 15:
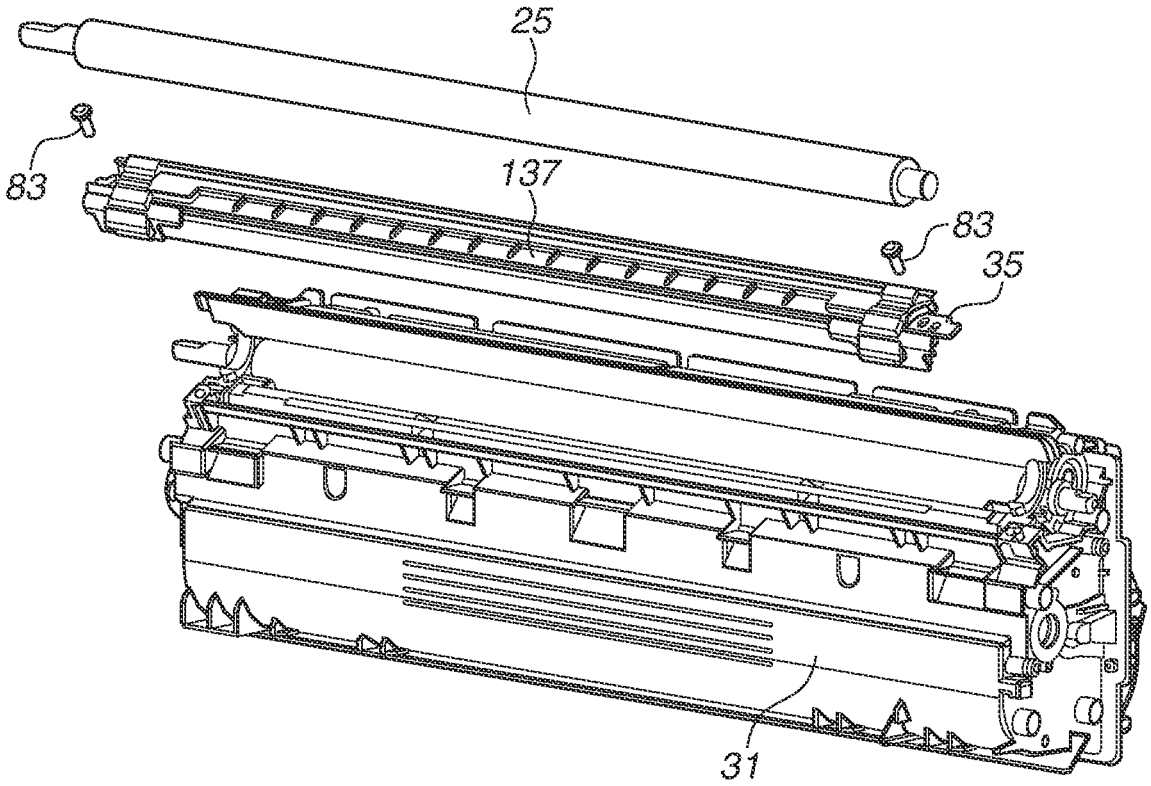
FIG. 15 is an exploded perspective view illustrating a disassembled state of the developing cartridge according to the first example embodiment.

Next, a method for recycling the developing cartridge 4 will be described with reference to FIGS. 1, 13, 14, and 15. FIG. 1 is a partial enlarged view illustrating the developing cartridge 4 with the cover portion 137*r* of the collecting member 137 removed. FIG. 13 illustrates a removal range of the cover portion 137*r* of the collecting member 137. FIG. 13 illustrates the developing cartridge 4 when viewed in the direction perpendicular to the first portion 35*b*1 of the developing blade 35. FIG. 14 illustrates a removal range of the cover portion 137*r* of the collecting member 137. FIG. 15 is an exploded perspective view illustrating a disassembled state of the developing cartridge 4.

As illustrated in FIG. 13, the collecting member 137 includes the cover portion 137*r*. The cover portion 137*r* covers at least a part of the head 83*a* of the screw 83. In other words, the position of the head 83*a* and the position of the cover portion 137*r* overlap with each other in the extension direction of the first portion 35*b*1 in contact with the head 83*a*.

The cover portion 137*r* is positioned outside the two-sided adhesive tape 138 in the longitudinal direction of the developing blade 35. In other words, the position of the cover portion 137*r* does not overlap with the position of the two-sided adhesive tape 138 in the longitudinal direction of the developing blade 35. The cover portion 137*r* is also provided at the opposite end in the longitudinal direction of the developing blade 35. The opposite end in the longitudinal direction has a similar configuration, except for the shape of the guide 137*s*, and a description thereof will be generally omitted.

According to the present example embodiment, the method for recycling the developing cartridge 4 includes the method for disassembling the developing cartridge 4. The method for disassembling the developing cartridge 4 includes a process of preparing a used developing cartridge 4. The method for disassembling the developing cartridge 4 further includes a process of removing the developing roller 25 and a process of removing the developing blade 35. The method for recycling the developing cartridge 4 further includes a process of attaching the developing blade 35 or a new regulation member to the developing frame 31, and a process of filling the developing frame 31 with toner.

(Example Disassembling Developing Roller)

The first end member 37, the second end member 38, the side cover 20, the first developing bearing 12, and the second developing bearing 13, which are disposed at both ends of the developing cartridge 4 in the longitudinal direction, are removed from the developing frame 31 (refer to FIG. 7). These components are fixed to the developing frame 31 with screws, and therefore can easily be removed by using a tool such as a screw driver. After the first developing bearing 12 and the second developing bearing 13 have been removed from the developing frame 31, the developing roller 25 can be removed.

In the recycling process of the developing cartridge 4, the developing roller 25 removed may be cleaned and attached to the developing frame 31 again. A new developing roller 25 different from the developing roller 25 removed may be attached to the developing frame 31. The developing roller 25 removed from another developing cartridge 4 may also be attached to the developing frame 31.

For example, the process of removing the developing roller 25 can be omitted, if the developing roller 25 has a favorable condition or if other processes can be performed with no difficulty even without removing the developing roller 25.

(Example Process of Removing Developing Blade)

Next, a process of removing the developing blade 35 from the developing frame 31 will be described.

As described above, the developing blade 35 is fixed to the developing frame 31 by the screw 83. The screw 83 needs to be removed to remove the developing blade 35 from the developing frame 31. However, since the head 83*a* of the screw 83 is covered by the cover portion 137*r*, a tool such as a screw driver cannot be inserted into the groove 83*b*.

Thus, a process of removing at least a part of the cover portion 137*r* (cover removal process) is provided to reduce the size of the region of the head 83*a* to be covered by the cover portion 137*r*. In the cover removal process, the whole collecting member 137 may be removed from the developing blade 35. However, in the present example embodiment, a part of the collecting member 137 is removed.

According to the present example embodiment, the collecting member 137 is attached to the regulation portion 35*a* with the two-sided adhesive tape 138. Accordingly, removing the collecting member 137 from the developing blade 35 is difficult compared with a case where the collecting member 137 is attached by a removable member such as a screw. Further, the regulation portion 35*a* may be deformed or the regulation portion 35*a* may be peeled off from the supporting portion 35*b*, if the collecting member 137 is removed from the developing blade 35. As described above, the cover portion 137*r* is positioned outside the two-sided adhesive tape 138 in the longitudinal direction of the developing blade 35. Thus, the cover portion 137*r* can be easily removed by cutting a part of the collecting member 137, in a state where the collecting member 137 is attached to the regulation portion 35*a* by the two-sided adhesive tape 138. This arrangement enables preventing the regulation portion 35*a* from being deformed when the regulation portion 35*a* is removed from the cover portion 137*r*.

According to the present example embodiment, the cover portion 137*r* of the collecting member 137 is cut by using a tool such as a supersonic wave cutter along a G line, as illustrated in FIGS. 13 and 14. In the same manner, the cover portion 137*r* is cut even at the other end in the longitudinal direction of the developing blade 35.

As illustrated in FIG. 14, the cover portion 137 is cut at such a position where at least a part of the partition wall 137*g* for separating the collecting portion 140 and the cover portion 137*r* is left on the cover portion 137. This enables storing toner in the collecting portion 140 even if the cover portion 137*r* is removed. Further, the cover portion 137 is cut to leave the portion of the second receiving portion 137*j* where the elastic sealing member 139 is stuck. This arrangement enables preventing toner leakage from the collecting portion 140 even if the cover portion 137*r* is removed.

Accordingly, the exposed portion of the head 83*a* can be increased compared with a state before the cover portion 137*r* is removed. In other words, the size of the region of the head 83*a* covered by the cover portion 137*r* can be reduced compared with a state before the cover portion 137*r* is removed. In this case, it is preferable to remove the cover portion 137*r* so that the groove 83*b* formed on the head 83*a* is exposed.

FIG. 1 illustrates a state where the cover portion 137*r* is cut. As illustrated in FIG. 1, the screw 83 for fixing the developing blade 35 to the developing frame 31 is exposed.

The screw 83 is removed from the developing frame 31 by using a screw driver. The developing blade 35 is then removed from the developing frame 31. In this case, the developing blade 35 can be removed from the developing frame 31 in a state where the collecting member 137 is attached to the developing blade 35, as illustrated in FIG. 15. This arrangement enables removing the developing blade 35 from the developing frame 31 even without removing the entire collecting member 137 stuck by the two-sided adhesive tape 138 from the developing blade 35.

The above-described process of removing the developing blade 35 performs a process of attaching the developing blade 35 (described below). Thus, the process can be referred to as a process of manufacturing the developing frame 31 to which the developing blade 35 can be attached.

(Example Removing Toner)

After removing the collecting member 137 from the developing frame 31, the toner stored in the collecting portion 140 of the collecting member 137 (e.g., the first storage area 140*a*1 and the second storage area 140*a*2) is removed from the first opening 140*d*.

The toner adhering to the regulation portion 35*a* of the developing blade 35 is further removed.

(Example Process of Attaching Developing Blade)

In the recycling of the developing cartridge 4, the developing blade 35 and the collecting member 137 removed may be cleaned and then attached to the developing frame 31 again. A new developing blade 35 different from the developing blade 35 removed may be attached to the developing frame 31. In this case, it is preferable that a new collecting member 137 is also attached to the developing blade 35 (refer to FIG. 15). A developing blade 35 and a collecting member 137 removed from another developing cartridge 4 may also be attached to the developing frame 31.

The screw 83 is used to fix the developing blade 35. The screw 83 removed from the developing frame 31 can be used. A new screw 83 different from the screw 83 removed from the developing frame 31 can also be used.

(Example Process of Filling Developing Frame with Toner)

A process of filling the developing frame 31 with toner (refilling process) will be described. Toner has been consumed in a used developing cartridge 4. Therefore, the method for recycling the developing cartridge 4 includes a process of filling the developing frame 31 with new toner.

The developing frame 31 with the first developing bearing 12 removed is provided with a toner filling port closed by a toner cap (not illustrated). By removing the toner cap, the developing frame 31 can be refilled with toner via the toner filling port.

After refilling the developing frame 31 with toner, the developing roller 25, the first end member 37, the second end member 38, the side cover 20, the first developing bearing 12, and the second developing bearing 13 are attached to the developing frame 31. After attaching these members, it is also possible that, a hole is formed on the developing frame 31, toner is put into the developing frame 31, and then the hole is closed.

As described above, the present disclosure enables offering a method for recycling the developing cartridge 4 in which parts with toner adhesion can be cleaned without degrading original developing cartridge functions. The developing cartridge 4 can also be disassembled in a state where the collecting member 137 having the cover portion 137*r* for covering the screw 83 is attached to the developing blade 35. Therefore, the present disclosure enables offering a simple method for recycling the developing cartridge 4.

In a case where the user ends the use of the recycled developing cartridge 4 and recycles it again, the cover portion 137*r* of the collecting member 137 has been removed and the screw 83 has been exposed. Thus, recycling can be efficiently performed.

Second Example Embodiment

Next, another example of a method for recycling the developing cartridge 4 will be described below with reference to FIGS. 16, 17, 18A, 18B, and 19 as a second example embodiment.

Figure 16:
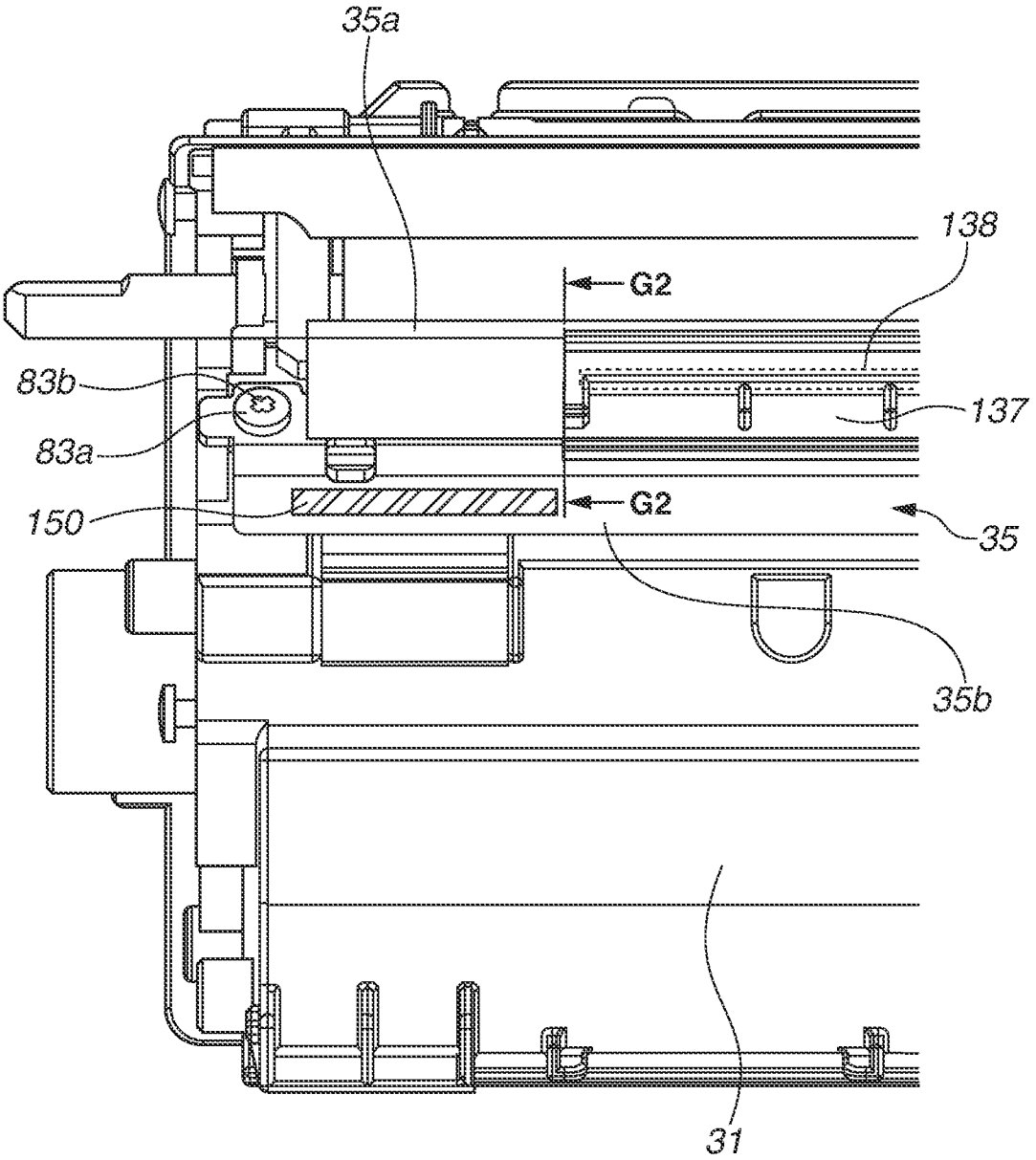
FIG. 16 illustrates a removal range of a collecting member according to a second example embodiment.
Figure 17:
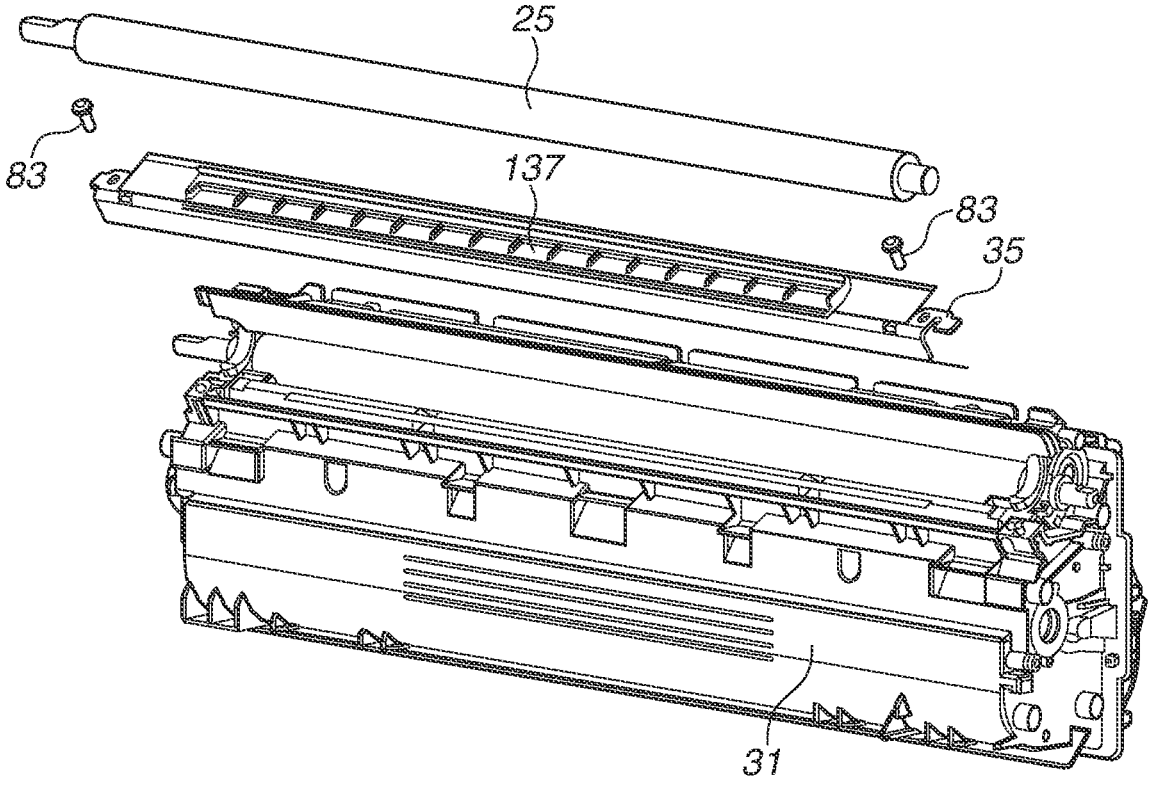
FIG. 17 is an exploded perspective view illustrating a disassembled state of a developing cartridge according to the second example embodiment.
Figure 18A:
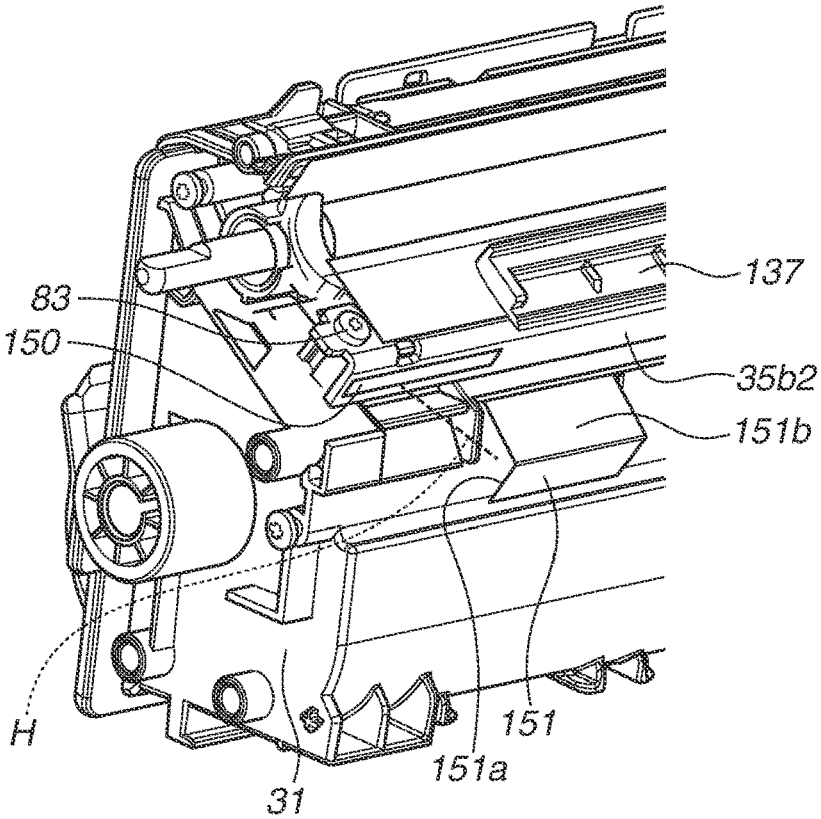
FIGS. 18A and 18B are perspective views illustrating an attachment of a new receiving member according to the second example embodiment.
Figure 18B:
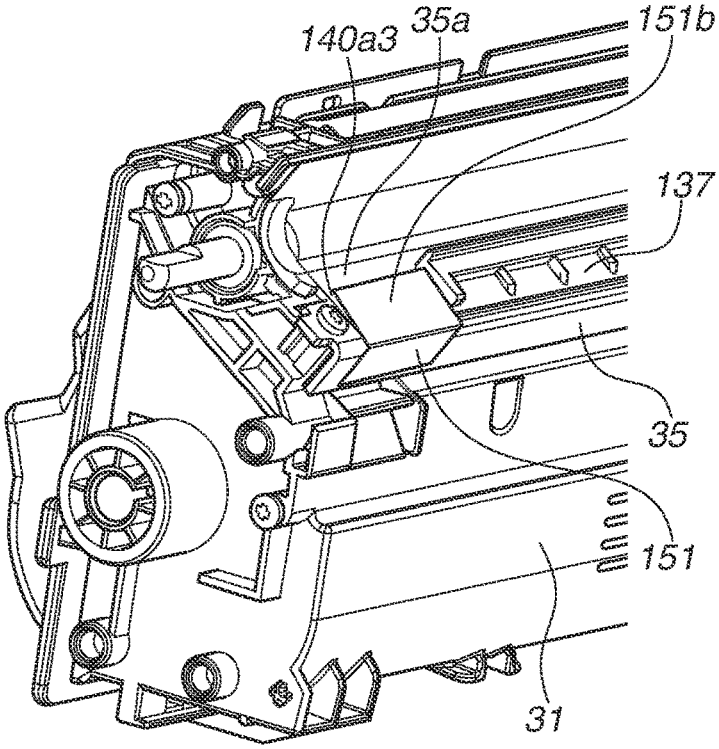
Figure 19:
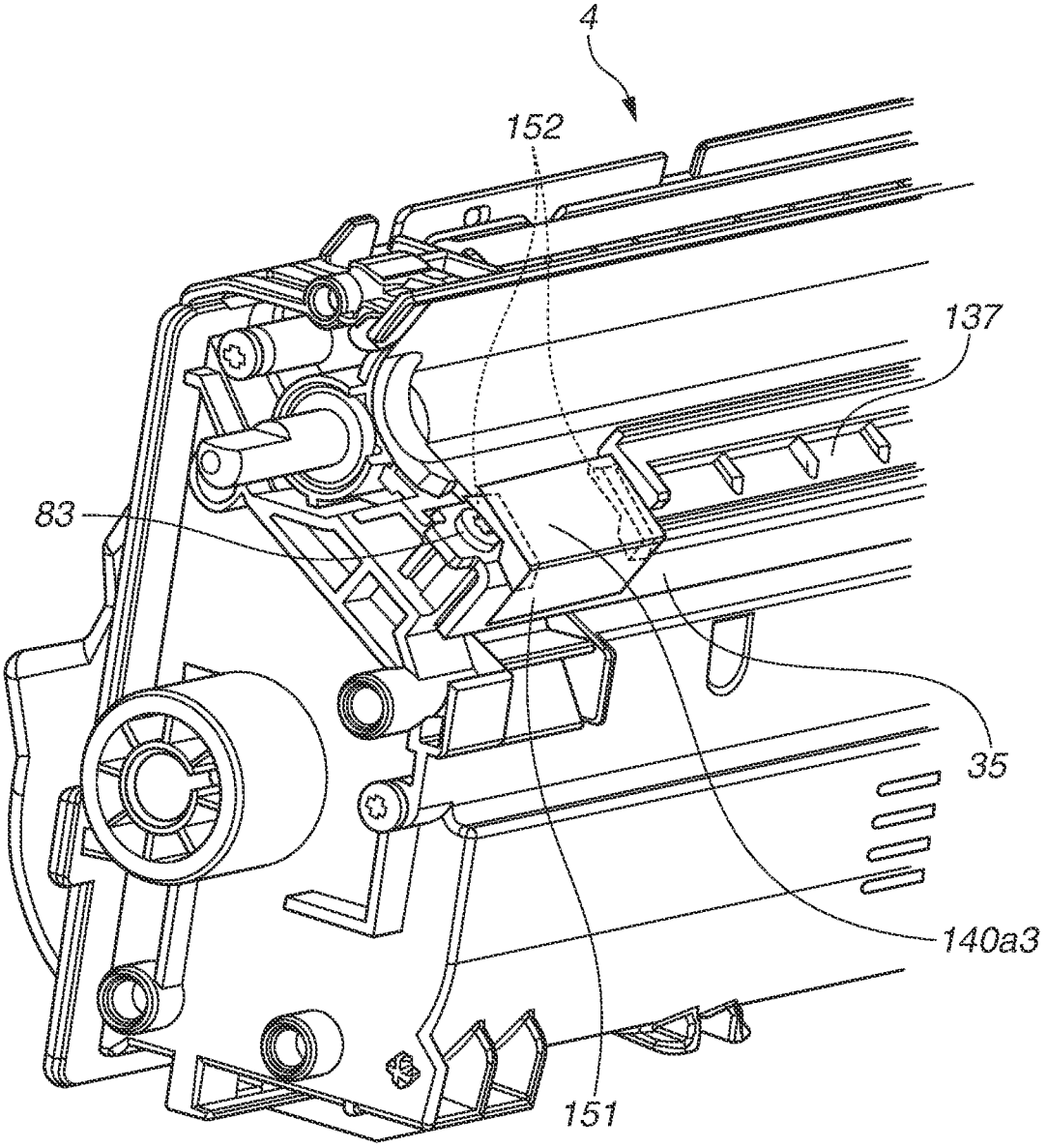
FIG. 19 illustrates a state where a new sealing member is attached to the new receiving member according to the second example embodiment.

FIG. 16 illustrates a removal range of the collecting member 137 with respect to the developing blade 35. FIG. 17 is an exploded perspective view illustrating the developing cartridge 4 disassembled. FIGS. 18A and 18B are perspective views illustrating the attachment of new receiving members. FIG. 18A illustrates a process of attaching a new receiving member 151. FIG. 18B illustrates a state where the new receiving member 151 has been attached. FIG. 19 illustrates a state where the new receiving member 151 is attached with sealing members 152.

The present example embodiment differs from the first example embodiment in the process of removing the cover portion 137*r* of the collecting member 137. The configuration of the apparatus main body 10, the configuration of the drum cartridge 9, and the configuration of the developing cartridge 4 before performing the recycling process are similar to those according to the first example embodiment. A process of preparing the developing cartridge 4, a process of removing the developing roller 25, and a process of filling the developing frame 31 with toner are similar to those according to the first example embodiment.

According to the present example embodiment, the cover portion 137*r* and the collecting portion 140 are removed from the collecting member 137. As illustrated in FIG. 16, the collecting member 137 is cut along a G2 line outside the two-sided adhesive tape 138 in the longitudinal direction of the developing blade 35. More specifically, the collecting member 137 is cut so that the partition wall 137*g* according to the first example embodiment is included in the removed portion. Likewise, the collecting member 137 is cut also at the other end in the longitudinal direction of the developing blade 35.

It is preferable to remove the toner stored in the collecting portion 140 (e.g., the first storage area 140*a*1 and the second storage area 140*a*2) before or after cutting the collecting member 137.

If the collecting member 137 is cut and the cover portion 137*r* is removed, the screw 83 is exposed. By removing the screw 83 with a screw driver, as illustrated in FIG. 17, the developing blade 35 can be removed from the developing frame 31 in a state where the collecting member 137 is fixed to the developing blade 35.

Thereafter, toner adhering to the regulation portion 35*a* of the developing blade 35 is cleaned, like the first example embodiment. The developing blade 35 to which the collecting member 137 is fixed is then fixed to the developing frame 31 with the screw 83. In this case, a new developing blade 35 may be used as described in the first example embodiment.

According to the present example embodiment, at least a part of the portion forming the collecting portion 140 (e.g., the first receiving portion 137*b* and the second receiving portion 137*j*) is removed, together with the cover portion 137*r*. Thus, it is preferable that, a portion functioning as the collecting portion 140 is formed, when the collecting member 137 and the developing blade 35 are reused. According to the present example embodiment, a new receiving member 151 is stuck on the collecting member 137.

As illustrated in FIGS. 16 and 18A, a two-sided adhesive tape 150 is stuck on the second portion 35*b*2 of the developing blade 35. As illustrated in FIG. 18A, the new receiving member 151 is attached to the supporting portion 35*b* from the direction indicated by an arrow H.

The new receiving member 151, which has a first end 151*a* and a second end 151*b*, is a seat member with a bending portion formed between the first end 151*a* and the second end 151*b*. The first end 151*a* is fixed to the supporting portion 35*b*2 with the two-sided adhesive tape 150. The second end 151*b* is disposed so that a gap is formed between the developing blade 35 and the second end 151*b*. This gap forms a new storage portion 140*a*3 for storing toner. The storage portion 140*a*3 is formed at the position corresponding to the collecting portion 140.

Gaps are formed between both ends of the developing frame 31 and the new receiving member 151, in the longitudinal direction of the developing blade 35. As illustrated in FIG. 19, it is preferable to attach the sealing members (e.g., new sealing members) 152 for sealing the gaps to the developing frame 31 or the new receiving member 151. A silicon bond and a hot melt can be used as the sealing members 152.

Thereby, the storage portion 140*a*3 is formed, and thus makes it possible to prevent the toner stored in the storage portion 140*a*3 from scattering when the user handles the developing cartridge 4 after removing the developing cartridge 4 from the image forming apparatus.

The above-described method for recycling the developing cartridge 4 includes the method for disassembling the used developing cartridge 4. The above-described method for recycling the developing cartridge 4 may be referred as a method for disassembling a used developing cartridge 4 (e.g., first developing cartridge) and for manufacturing a new developing cartridge 4 (e.g., second developing cartridge).

The order of the processes included in the method for recycling the developing cartridge 4 can be suitably selected as required. Processes which do not need to be performed can be omitted.

According to the present disclosure, it is possible to offer a method for disassembling a developing device including a regulation member and a cover member. The regulation member regulates a developer, and is fixed to a frame by a fixing member. The cover member is attached to the regulation member so as to cover the fixing member. More specifically, it is possible to offer a method for removing the regulation member from the frame even if the cover member covers the fixing member.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-033354, filed Feb. 26, 2019, which is hereby incorporated by reference herein in its entirety.

What is claimed is:

1. A method for disassembling a developing device, comprising:

cover removing for removing at least a part of a cover portion of the developing device to expose a head of the developing device covered by the cover portion, wherein the developing device comprises:

a frame configured to store a developer;

a developing roller configured to bear the developer, the developing roller being rotatably supported by the frame;

a developing blade including a supporting portion and a regulation portion configured to regulate the developer borne by the developing roller, the regulation portion being fixed to the supporting portion and contacting the developing roller, and the supporting portion fixed to the frame and supporting the regulation portion;

a screw configured to fix the developing blade to the frame, the screw having the head configured to hold the developing blade, the head being disposed so that the developing blade is sandwiched between the head and the frame; and a cover member directly attached to the developing blade via a two-sided adhesive tape and having the cover portion, the cover portion disposed so as to cover at least a part of the head;

removing the screw from the frame; and removing the developing blade from the frame.

2. A method for disassembling the developing device according to claim 1, wherein the regulation portion is welded to the supporting portion.

3. The method for disassembling the developing device according to claim 1, wherein the two-sided adhesive tape is attached to the regulation portion.

4. The method for disassembling the developing device according to claim 3, wherein the cover portion is positioned outside the two-sided adhesive tape in the longitudinal direction of the developing blade.

5. The method for disassembling the developing device according to claim 3, wherein the cover removing is performed in a state where the cover member is attached to the regulation portion via the two-sided adhesive tape.

6. The method for disassembling the developing device according to claim 1, wherein the head is provided with a groove formed on the head, and wherein, in the cover removing, the cover portion is removed so that the groove is exposed.

7. The method for disassembling the developing device according to claim 1, wherein the cover member is attached to the developing blade such that a space for storing the developer is formed between the cover and the developing blade, and wherein the cover member includes a partition wall configured to separate the cover portion and the space.

8. The method for disassembling the developing device according to claim 7, wherein, in the cover removing, at least a part of the partition wall is left on the cover member.

9. The method for disassembling the developing device according to claim 1, wherein the regulation portion is welded to the supporting portion, and wherein the two-sided adhesive tape is attached to the regulation portion.

10. The method for disassembling the developing device according to claim 9, wherein the cover portion is positioned outside the two-sided adhesive tape in a longitudinal direction of the developing blade.

11. The method for disassembling the developing device according to claim 10, wherein the cover removing is performed in a state where the cover member is attached to the regulation portion via the two-sided adhesive tape.

12. The method for disassembling the developing device according to claim 10, wherein the head is provided with a groove formed on the head, and wherein, in the cover removing, the cover portion is removed so that the groove is exposed.

13. The method for disassembling the developing device according to claim 12, wherein the cover member is attached to the developing blade such that a space for storing the developer is formed between the cover and the developing blade, and wherein the cover member includes a partition wall configured to separate the cover portion and the space.

14. A method for recycling a developing device, the method comprising:

the method for disassembling the developing device according to claim 1;

filling the frame with a developer; and attaching the developing blade to the frame.

15. The method for recycling the developing device according to claim 14, the method comprising attaching a receiving member to the developing blade, wherein the receiving member is attached to the developing blade such that a space for storing a developer is formed between the receiving member and the developing member.

16. A method for recycling a developing device, the method comprising:

the method for disassembling the developing device according to claim 1;

filling the frame with a developer; and attaching a new developing blade different from the developing blade to the frame.

17. A method for recycling a developing device, the method comprising:

the method for disassembling the developing device according to claim 12;

filling the frame with a developer; and attaching the developing blade to the frame.

18. A method for recycling a developing device, the method comprising:

the method for disassembling the developing device according to claim 12;

filling the frame with a developer; and attaching a new developing blade different from the developing blade to the frame.

* * * * *